US007832311B2

(12) United States Patent
Cheng

(10) Patent No.: US 7,832,311 B2
(45) Date of Patent: Nov. 16, 2010

(54) EXTENSION BAR WITH ILLUMINATION DEVICE

(76) Inventor: Chin-Shun Cheng, No. 37-2, Ching-Dau 1st Street, Taichung (TW) 40464

( * ) Notice: Subject to any disclaimer, the term of this patent is extended or adjusted under 35 U.S.C. 154(b) by 108 days.

(21) Appl. No.: 12/329,639

(22) Filed: Dec. 8, 2008

(65) Prior Publication Data

US 2010/0139460 A1 Jun. 10, 2010

(51) Int. Cl.
*B25B 23/18* (2006.01)

(52) U.S. Cl. ..... 81/177.85; 362/119; 362/120

(58) Field of Classification Search ..... 81/177.85, 81/121.1, 124.6, 177.2, 177.5; 362/119, 362/120, 202, 203
See application file for complete search history.

(56) References Cited

U.S. PATENT DOCUMENTS 5,477,434 A * 12/1995 Reed ..... 362/119
6,183,103 B1 * 2/2001 Hillinger ..... 362/119
6,776,500 B1 * 8/2004 Chen ..... 362/119
7,401,938 B1 * 7/2008 Cheng ..... 362/120
7,434,952 B1 * 10/2008 Wang ..... 362/119
7,604,368 B2 * 10/2009 Cheng ..... 362/120

* cited by examiner

*Primary Examiner*—Hadi Shakeri

(57) ABSTRACT

An extension bar includes an elongate body, a conductive unit, a control unit and an illumination unit. The conductive unit includes a non-conductive first piece, a non-conductive second piece and a conductive third piece which is separated from the body. A conductive bead is engaged with one end of the third piece. The control unit includes a first control member and a second control member which has an opposite conductivity to the first control member. The first control member is mounted to the body and includes a first recess and a second recess. The second control member is securely engaged with the first recess and in contact with the exterior of the body. The illumination unit includes an illumination part and a power supply unit which contacts between the illumination part and the third piece.

19 Claims, 26 Drawing Sheets

EXTENSION BAR WITH ILLUMINATION DEVICE

FIELD OF THE INVENTION

The present invention relates to an extension bar cooperated with a hand tool, and more particularly, to an extension bar having an illumination device which can be controlled by different arrangements, or can be operated when the bit is connected to the driving head.

BACKGROUND OF THE INVENTION

A conventional hand tool with a driving head can be optionally connected with an extension rod, an adaptor and different shapes of bits. The driving head generally includes a connection end and an engaging end, wherein the connection end is connected to the bits for example and the engaging end is connected with the hand tool such as a wrench.

U.S. Pat. No. 5,477,434 discloses an extension bar with a built-in light and a power supply unit, when the hand tool is connected to the extension bar, the built-in light and the power supply unit are activated so as to form the circuit. However, the circuit cannot be activated by a switch when the hand tool is removed from the extension bar, in other words, the built-in light cannot be individually used as a flashlight and is restricted.

U.S. Pat. No. 6,183,103 discloses an extension bar with selective illumination, wherein the two illumination members are located on two sides of the extension bar and a switch is available on the extension bar, wherein two non-conductive members are connected to two ends of the switch which cut off the circuit when the non-conductive members are in contact with the illumination members. When the conductive portion of the switch is in contact with the illumination member, the circuit is formed so that the extension bar can be individually used as a flashlight. When the driving head of a wrench is connected to the extension bar, the illumination member can also be activated by operation of the switch. However, it the inconvenient for the user because the illumination member has to be activated by operation of the switch when the driving head of a hand tool is connected to the extension bar.

The present invention intends to provide an extension bar which includes a body, a conductive unit, a control unit and an illumination unit, wherein the user can operates the control unit to directly control the illumination unit. The control unit can be easily removed from the body to replace parts therein. The illumination unit can be automatically activated when the extension bar is connected with a hand tool.

SUMMARY OF THE INVENTION

The present invention relates to an extension bar for connecting with a hand tool and the extension bar comprises an elongate body with a passage defined axially therein and two radial holes, a conductive unit located in the radial holes, a control unit mounted to the body, and an illumination unit located in the passage. The conductive unit includes a non-conductive first piece, a non-conductive second piece and a conductive third piece which is separated from the body. A conductive bead is engaged with one end of the third piece. The control unit includes a first control member and a second control member which has an opposite conductivity to the first control member. The first control member is mounted to the body and includes a first recess and a second recess. The second control member is securely engaged with the first recess and in contact with the exterior of the body. The illumination unit includes an illumination part and a power supply unit which contacts between the illumination part and the third piece.

The primary object of the present invention is to provide an extension bar, wherein the illumination unit can be controlled by operation of the control unit and the extension bar can be used as a flashlight.

Another object of the present invention is to provide an extension bar, wherein the control unit can be easily removed from the body so as to replace parts in the extension bar.

Yet another object of the present invention is to provide an extension bar, wherein the illumination unit is activated automatically when a hand tool is connected to the engaging hole.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
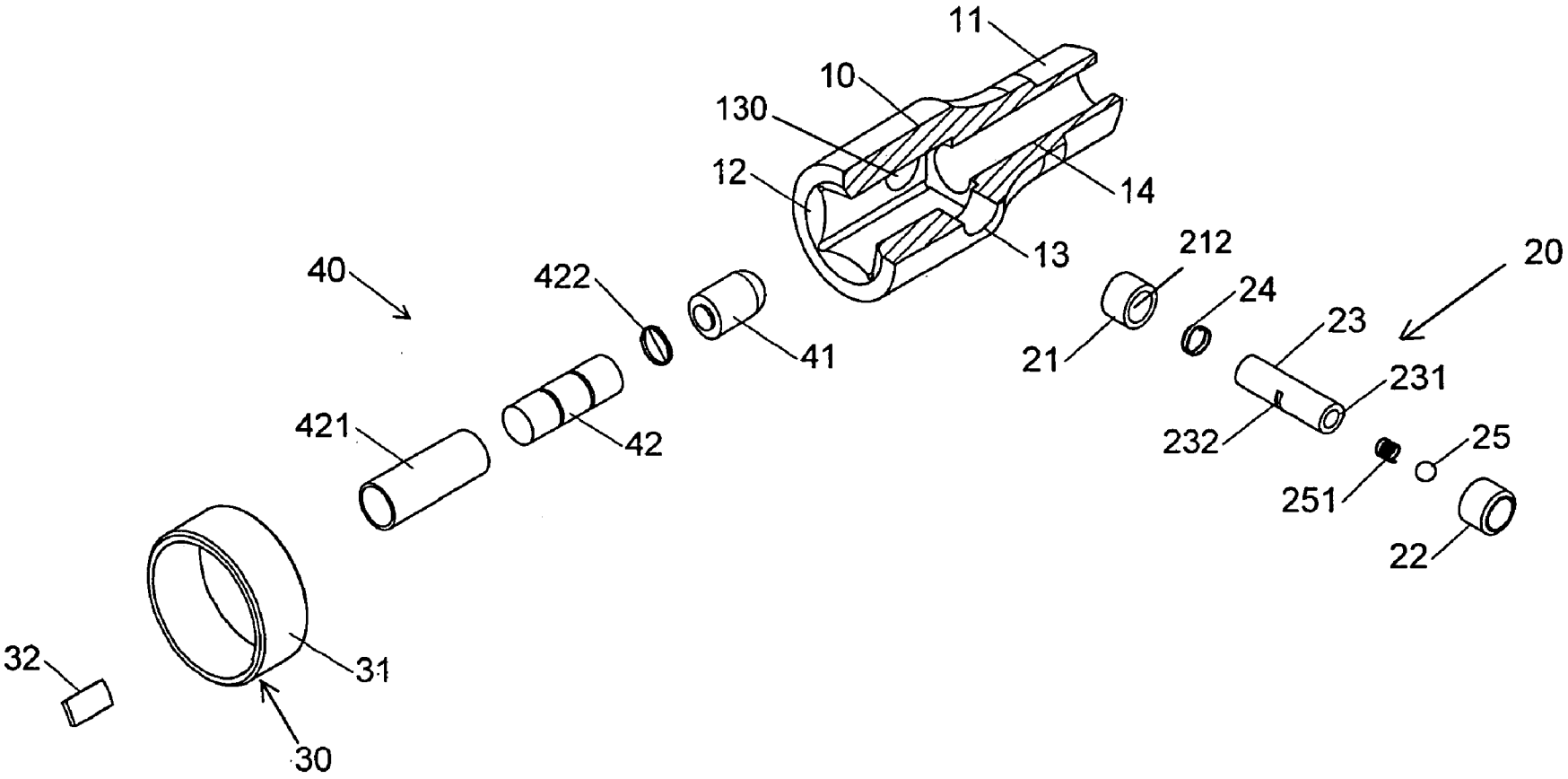
FIG. 1 is an exploded view to show a first embodiment of the extension bar of the present invention.
Figure 2:
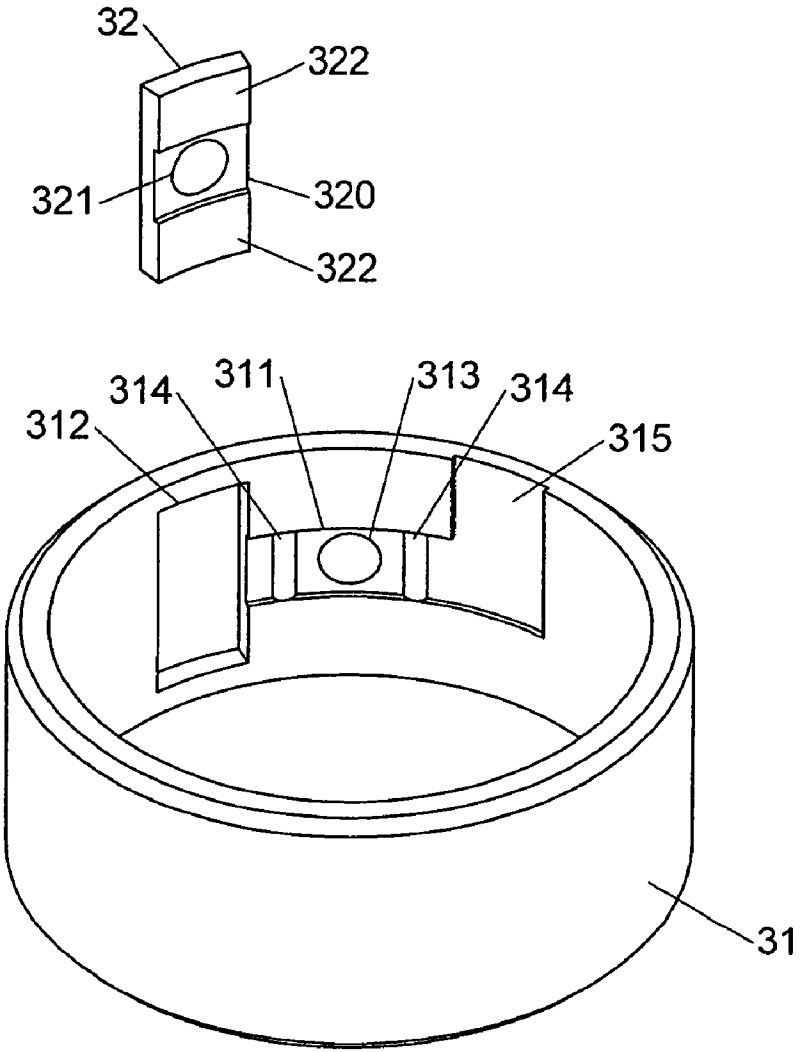
FIG. 2 is an exploded view to show the control unit of the first embodiment of the extension bar of the present invention.
Figure 3:
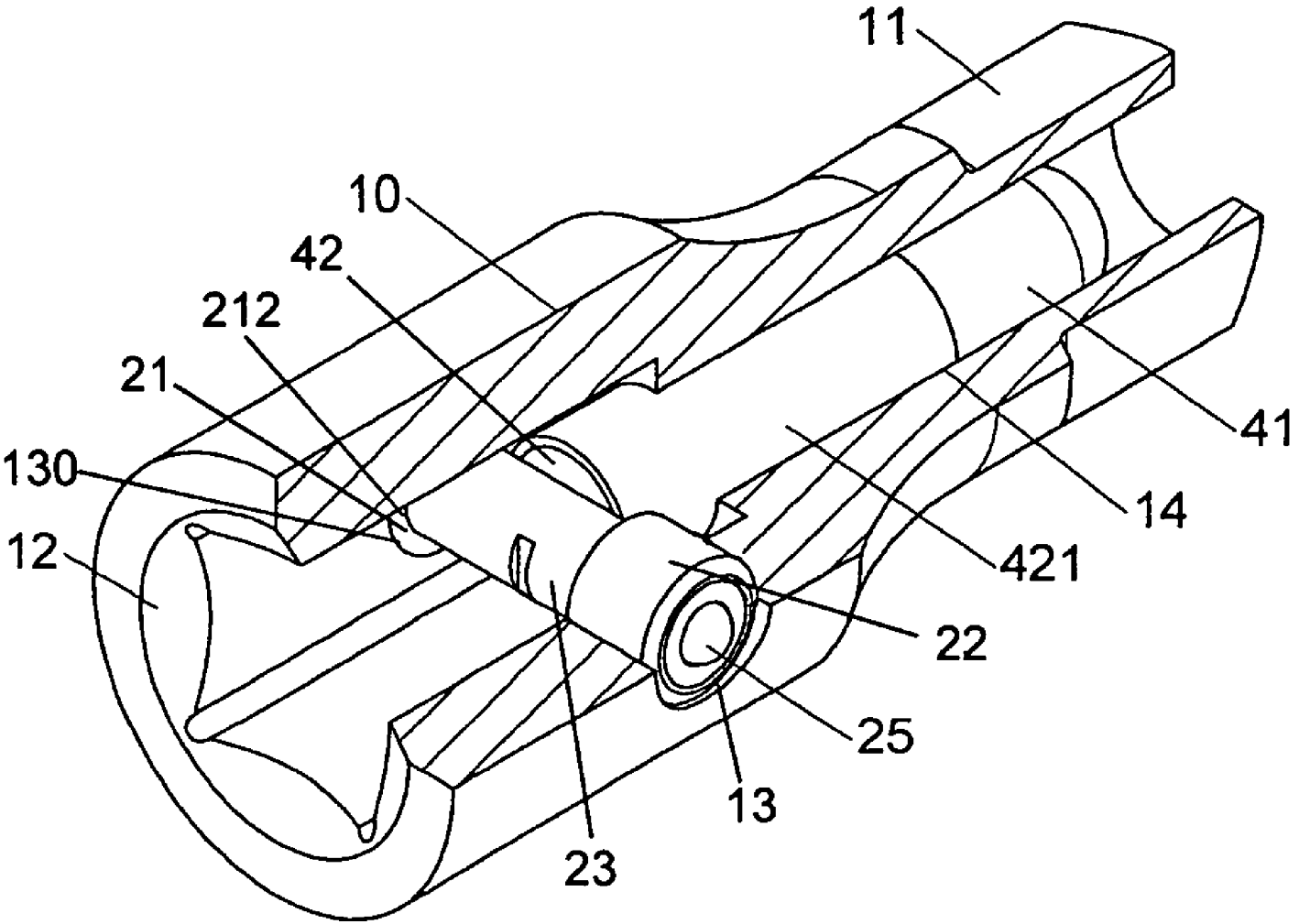
FIG. 3 is a perspective view, partly removed, of the first embodiment of the extension bar of the present invention.
Figure 4:
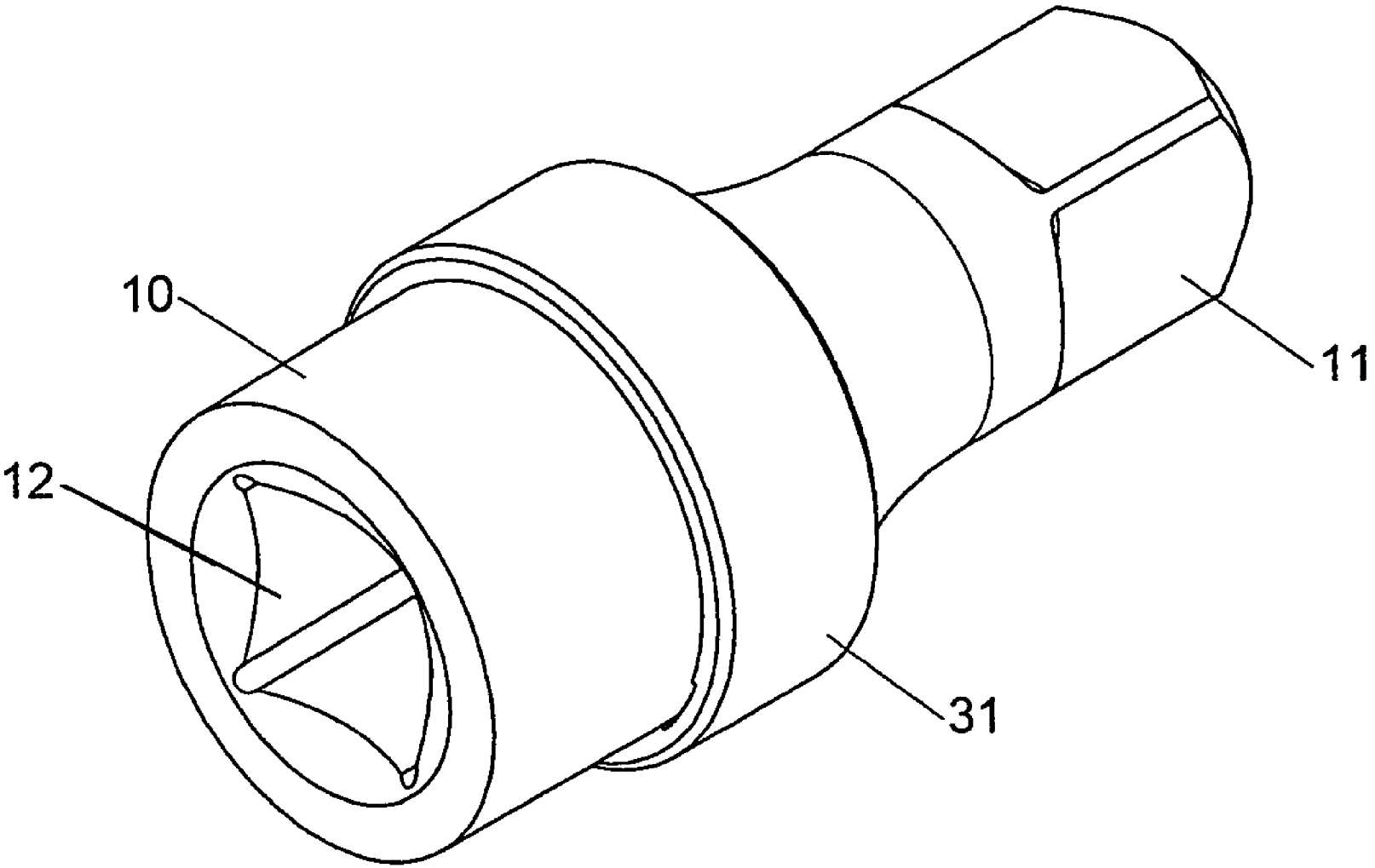
FIG. 4 is a perspective view of the first embodiment of the extension bar of the present invention.
Figure 5:
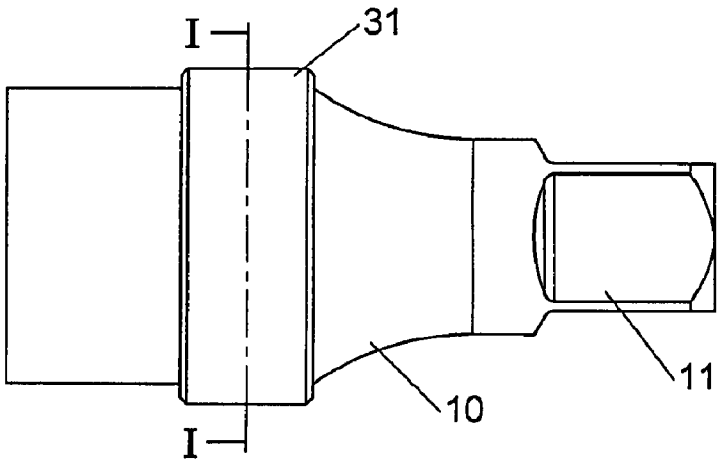
FIG. 5 is a side view of the first embodiment of the extension bar of the present invention.

Referring to FIGS. 1 to 4, the extension bar of the present invention comprises an elongate body 10 which includes a rectangular connection end 11 at a first end thereof and a rectangular engaging hole 12 is defined in a second end of the body 10. Two radial holes 13, 130 aligned along an axis and defined on a circular wall of the body 10 and communicating with the engaging hole 12, and at least one radial hole 13 through the wall of the body 10. A passage 14 is defined axially through the body 10 and communicates with the engaging hole 12.

A conductive unit 20 is located in the radial holes 13 of the body 10 and includes a first piece 21 which is located in one of the radial hole 130 and has an opening 212. The first piece 21 is a non-conductive member. A second piece 22 is a cylindrical member and located in the other radial hole 13. The second piece 22 is a non-conductive member. A conductive third piece 23 is a cylindrical member and longer than a width of the engaging hole 12. The first and second pieces 21, 22 are mounted on two ends of the third piece 23 so that the two ends of the third piece 23 are separated from the body 10 by the first and second pieces 21, 22. The third piece 23 includes a reception hole 231 defined in one end thereof, and a second spring 251 and a conductive bead 25 are engaged with the reception hole 231. The bead 25 is a ball-shaped member and in contact with the third piece 23. The bead 25 partially protrudes beyond the exterior of the body 10 by the second spring 251. A first spring 24 is located between the first and third pieces 21, 23.

A control unit 30 is mounted to the body 10 and located corresponding to the radial holes 13, 130. The control unit 30 includes a first control member 31 and a second control member 32. The first control member 31 is a ring-shaped member and includes an inner periphery to fit the body 10 so that the first control member 31 is rotatable relative to the body 10. The first control member 31 is located to hide the radial holes 13, 130. A first recessed area 311 is defined in the inner periphery of the first control member 31 and extends about ¼ of the inner periphery of the first control member 31. The first recessed area 311 includes a first recess 312 at a first position and a second recess 313 at a second position. The first recess 312 is a rectangular recess and includes two closed ends, or two open ends, or one closed end and one open end. The second recess 313 of the first control member 31 is a circular recess. The bead 25 is engaged with the second recess 313. The first recess 312 and the second recess 313 are separated by a ridge 314 located therebetween. The first recessed area 311 includes a third recess 315 at a third position thereof and the third recess 315 includes an open end. The second recess 313 and the third recess 315 are separated by another ridge 314 located therebetween.

The second control member 32 is securely engaged with the first recess 312, and includes a second recessed area 320 which is located corresponding to the second recess 313. A circular recess 321 is defined in the second recessed area 320 and receives the bead 25. The second recessed area 320 is located between two protrusions 322 which have the same curvature as an inner periphery of the first control member 31. The protrusions 322 contact the exterior of the body 10.

When the first control member 31 is made to be conductive, the second control member 32 is made to be non-conductive, and vice versa.

An illumination unit 40 is located in the passage 14 of the body 10 and includes an illumination part 41 located in the passage 14 and in contact with an inner periphery of the passage 14. A power supply unit 42, such as batteries, is located in the passage 14 and has a first end being in contact with the illumination part 41. A second end of the power supply unit 42 is in contact with the third piece 23 and not in contact with the body 10.

A non-conductive separation member 421 is mounted to the power supply unit 42 so as to separate the power supply unit 42 from the body 10. A third spring 422 is located between the power supply unit 42 and the illumination part 41.

As shown in FIGS. 5 to 8, which show that the circuit is not formed, wherein the bead 25 is engaged with the second recess 313, because the first control member 31 is non-conductive, the power supply unit 42 cannot provide power to the illumination part 41.

Figure 9:
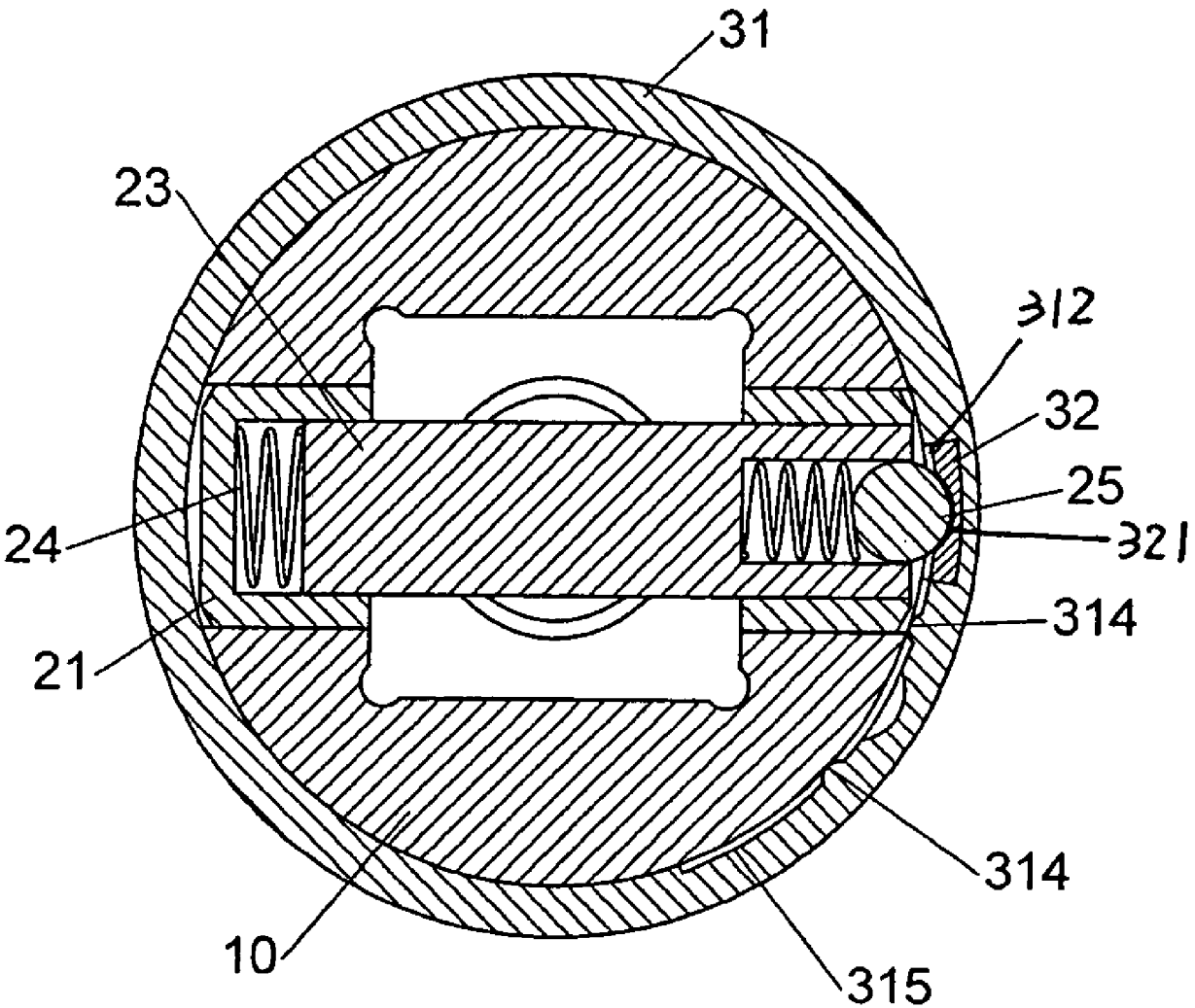
FIG. 9 is an end cross sectional view to show that the bead is in contact with the second control member.
Figure 10:
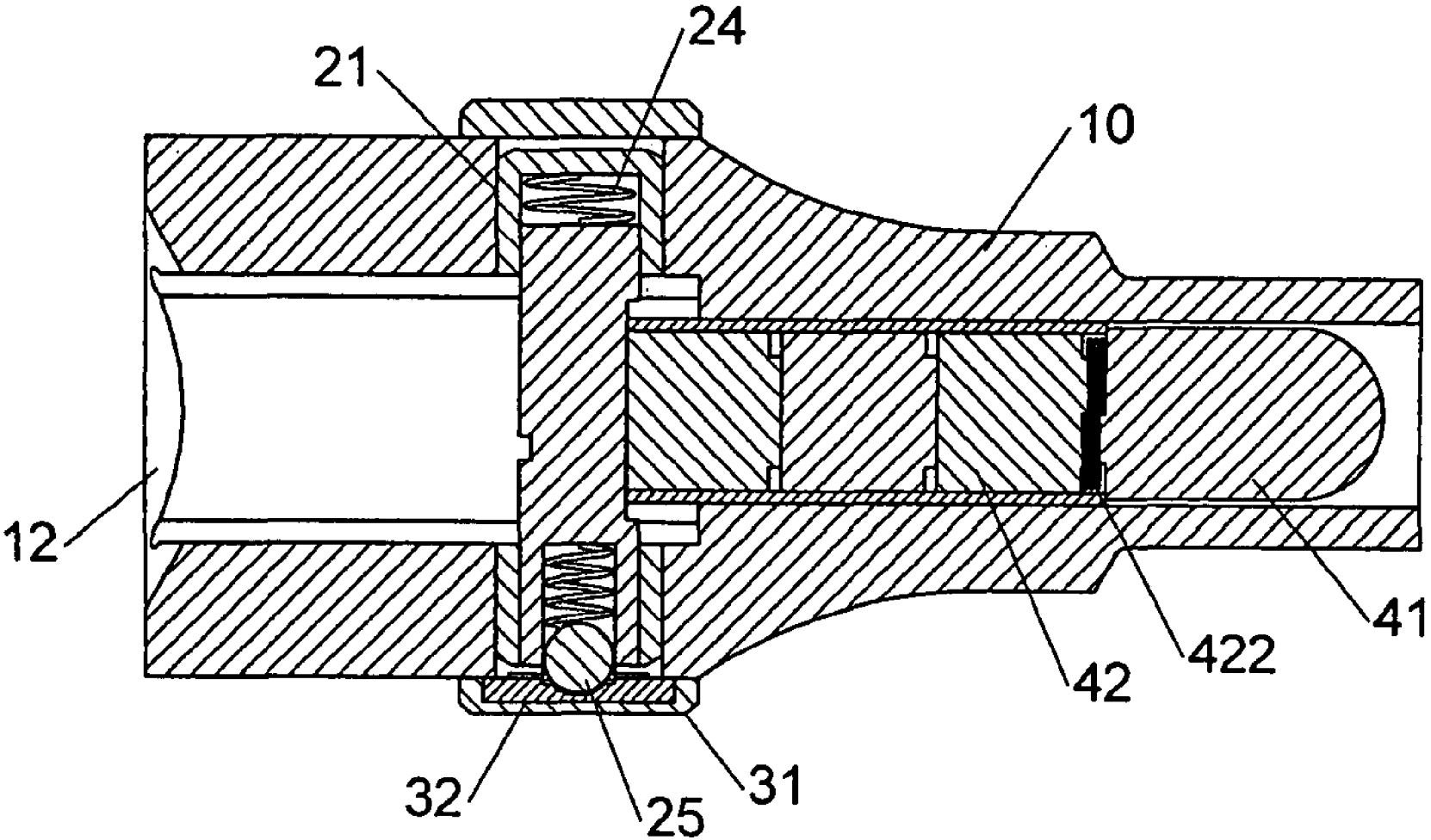
FIG. 10 is a side cross sectional view to show that the bead is in contact with the second control member.

As shown in FIGS. 9 and 10, when the user rotates the first control member 31 relative to the body 10 to shift the first recess 312 so that the bead 25 is engaged with the first recess 312, the bead 25 is in contact with the circular recess 321 of the second control member 32 which is conductive. The protrusions 322 are in contact with the body 10, so that the illumination part 41, the second control member 32, the power supply unit 42 and the body 10 form a circuit and the illumination part 41 illuminates.

Figure 11:
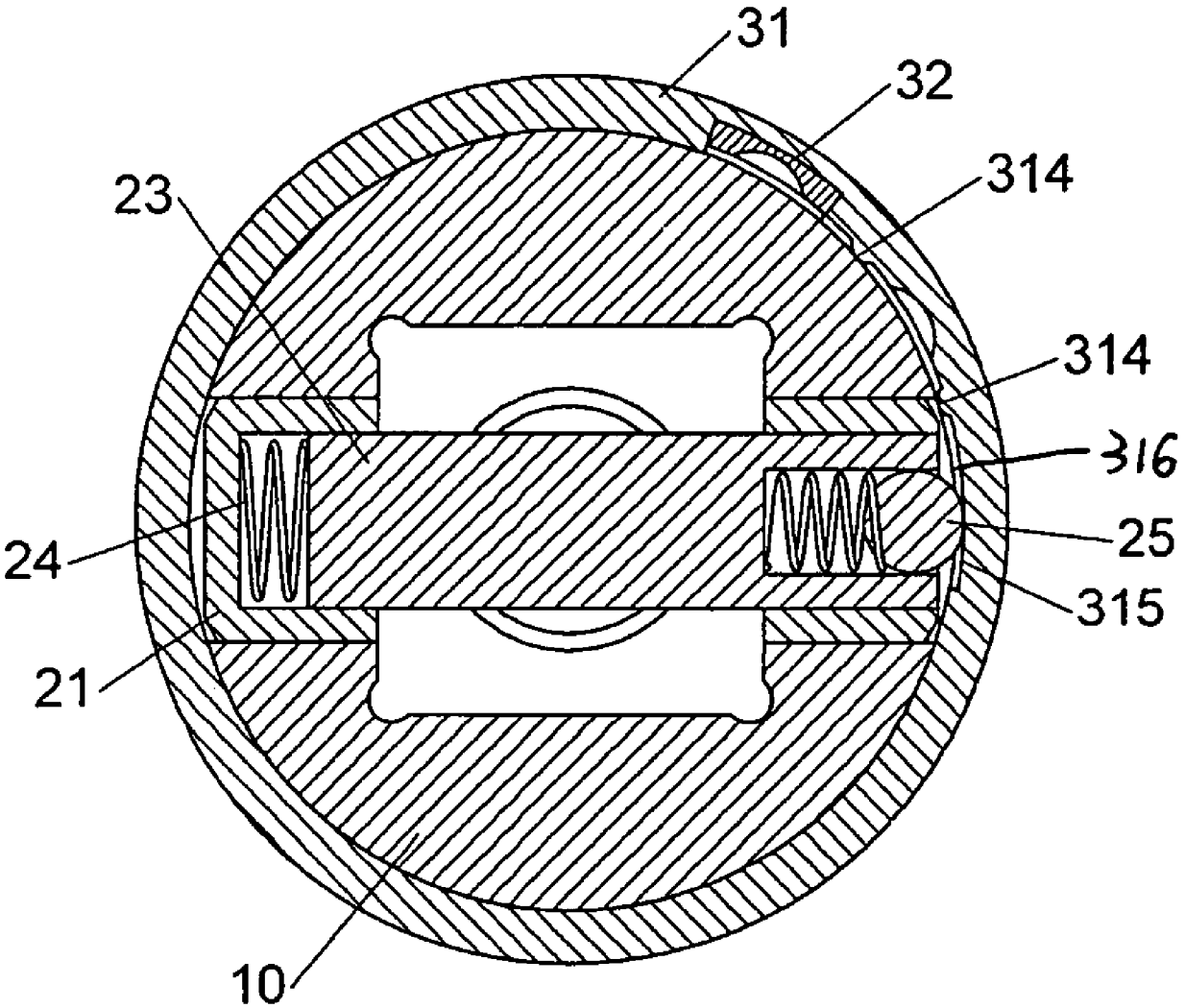
FIG. 11 is an end cross sectional view to show that the second control member is shifted away from the bead.

As shown in FIG. 11, when the user rotates the first control member 31 to shift the third recess 315 to face the bead 25, because of the opening 316 of the third recess 315, the control unit 30 can be separated from the bead 25 via the opening 316. The third piece 23 and the power supply unit 42 can be removed from the body 10 one by one such that the illumination part 42 can be replaced.

Figure 12:
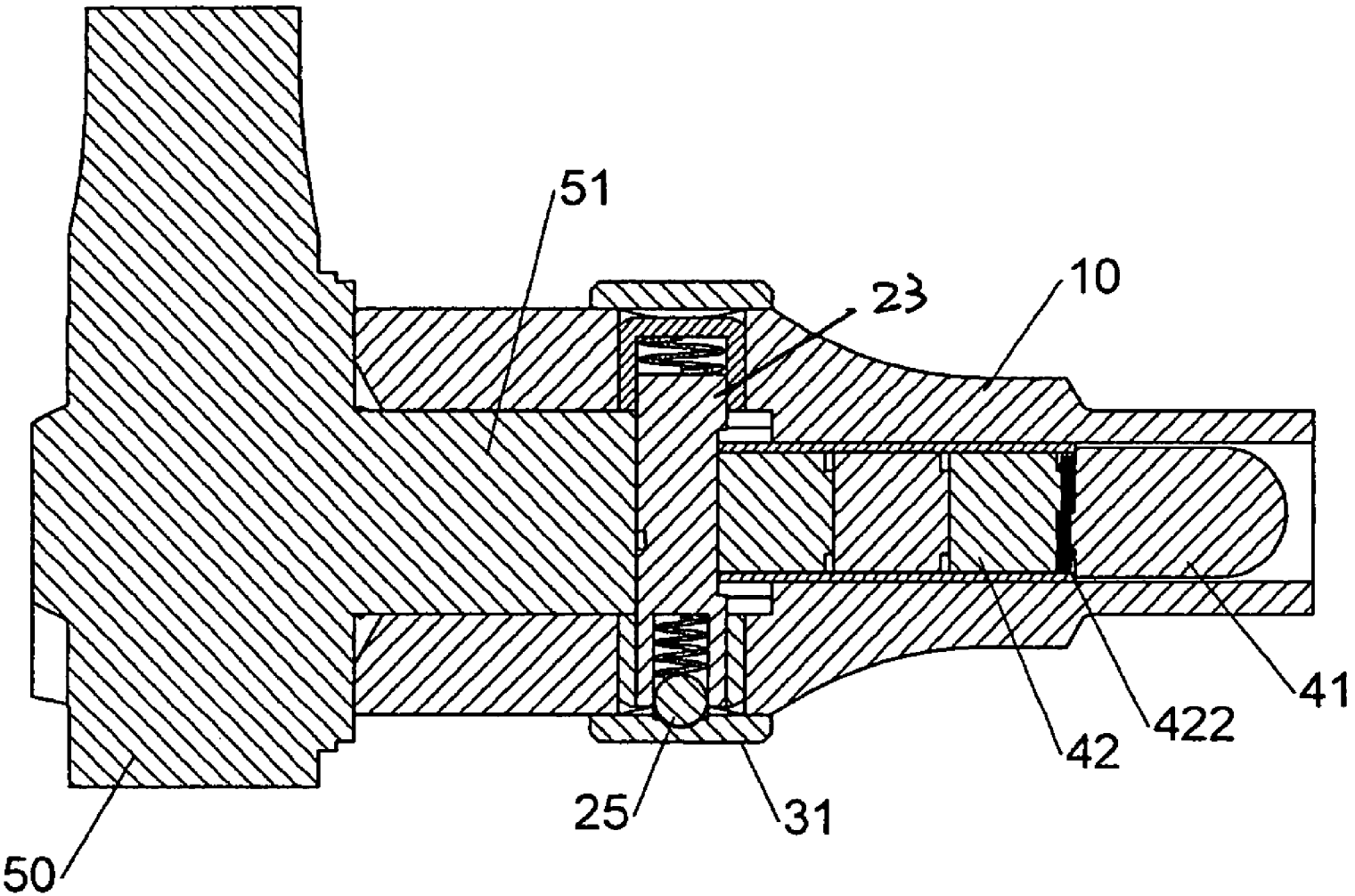
FIG. 12 is a side cross sectional view to show the second control member is shifted away from the bead.

When a square end 51 of the wrench 50 is engaged with the engaging hole 12 and contacts the third piece 23 as shown in FIG. 12, the circuit is formed via the power supply unit 42, the third piece 23, the square end 51, the body 10 and the illumination part 41 which then illuminates.

Figure 13:
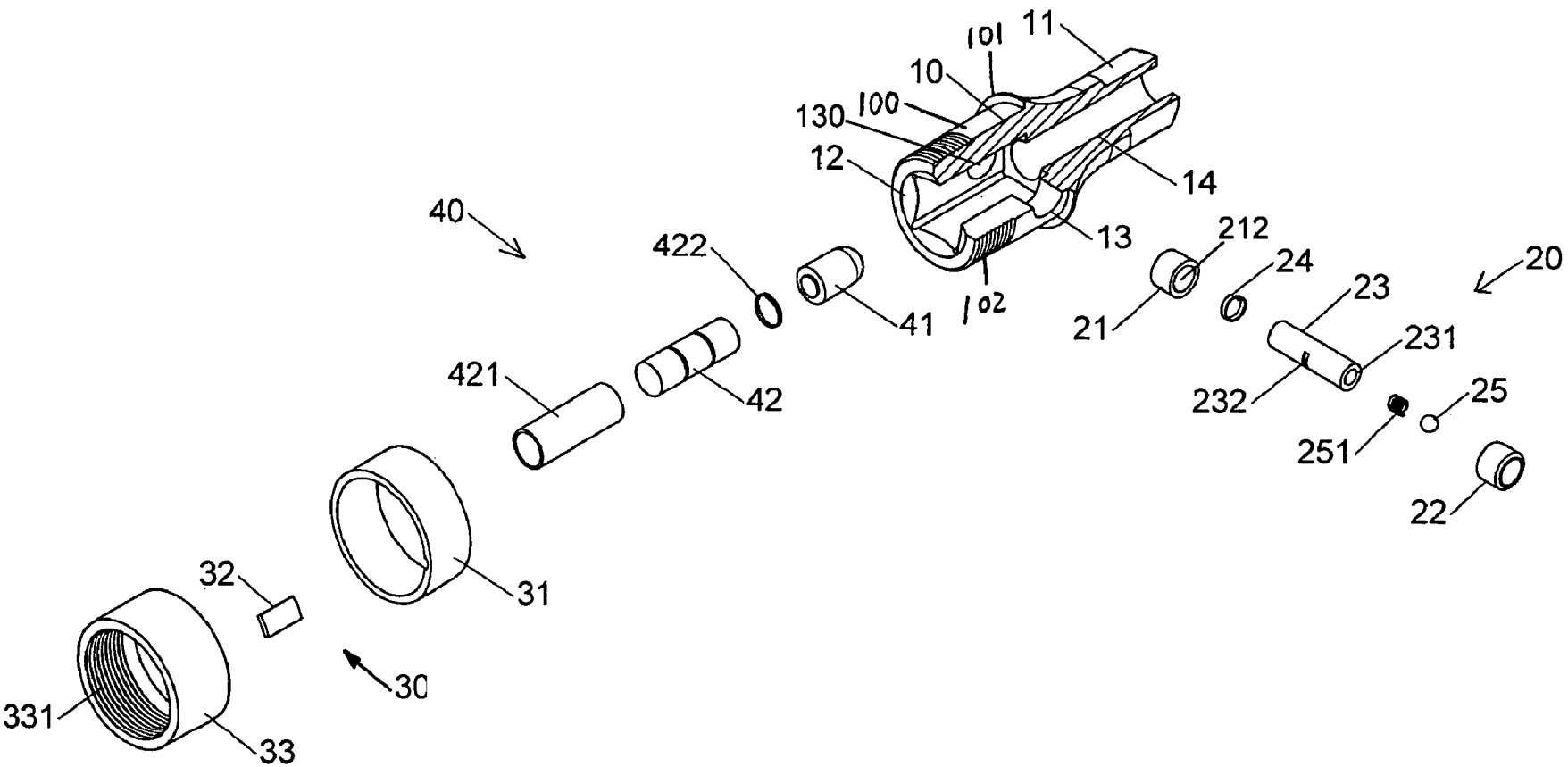
FIG. 13 is an exploded view to show a second embodiment of the extension bar of the present invention.
Figure 14:
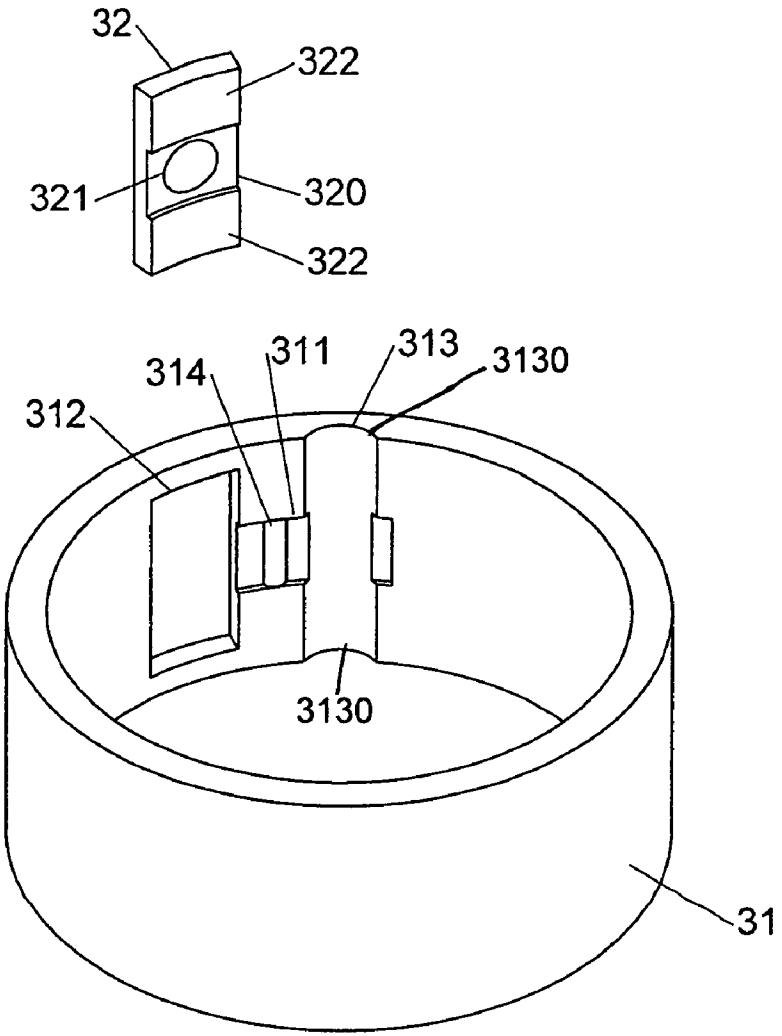
FIG. 14 is an exploded view to show the control unit of the second embodiment of the extension bar of the present invention.

FIGS. 13 and 14 show a second embodiment of the extension bar of the present invention, wherein an annular groove 100 is defined in the exterior of the body 10 and located close to the engaging hole 12. A flange 101 extends radially outward from the exterior of the body 10 and located on one end of the annular groove 100. A plurality outer threads 102 are defined in the exterior of the body 10 and located on the other end of the annular groove 100. An end ring 33 is threadedly connected to the outer threads 102 so that the first control member 31 is rotatably engaged with the annular groove 100 and restricted by the flange 101 and the end ring 33. The end ring 33, the first control member 31 and the exterior of the body 10 are in flush with each other. The second recess 313 of the first control member 31 includes two openings 3130 in two ends thereof. When the bead 25 is located within the second recess 313, the circuit is not formed so that the user can remove the first control member 31 from the body 10 by removing the end ring 33 from the body 10 first.

Figure 15:
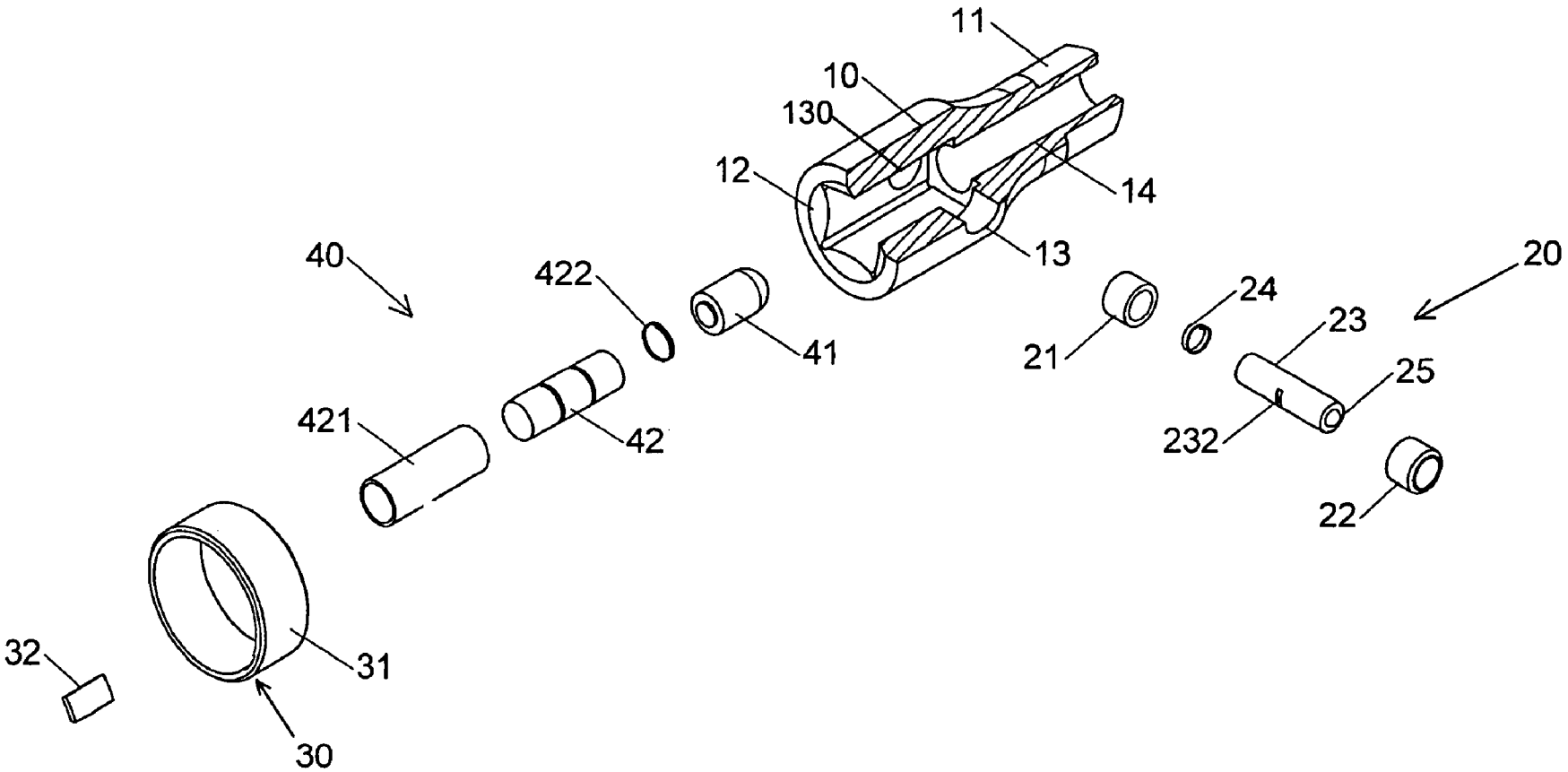
FIG. 15 is an exploded view to show a third embodiment of the extension bar of the present invention.
Figure 16:
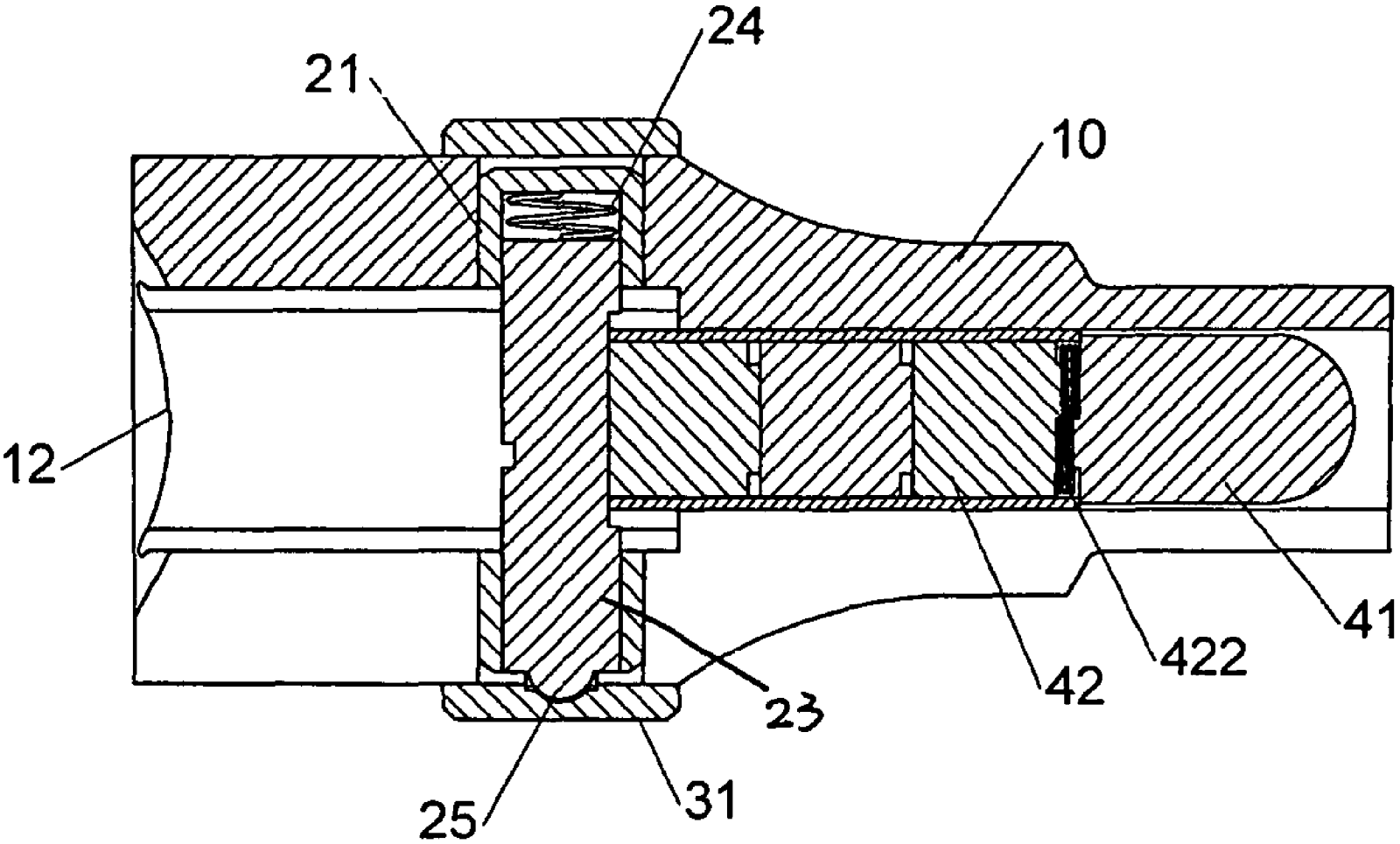
FIG. 16 is a side cross sectional view of the third embodiment of the extension bar of the present invention.

FIGS. 15 and 16 show that the third piece 23 and the bead 25 can be integrally formed as one piece.

Figure 17:
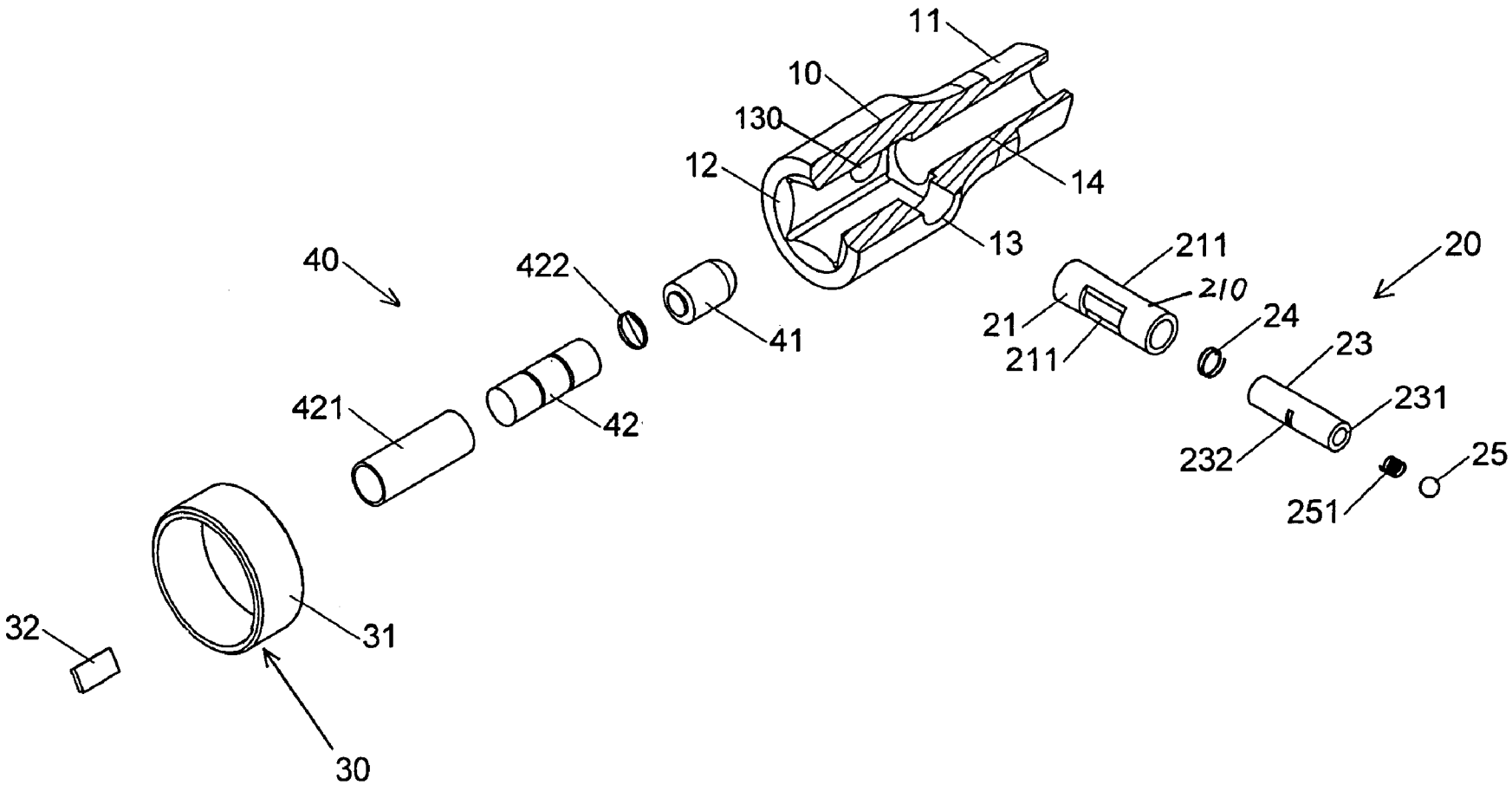
FIG. 17 is an exploded view to show a fourth embodiment of the extension bar of the present invention.
Figure 18:
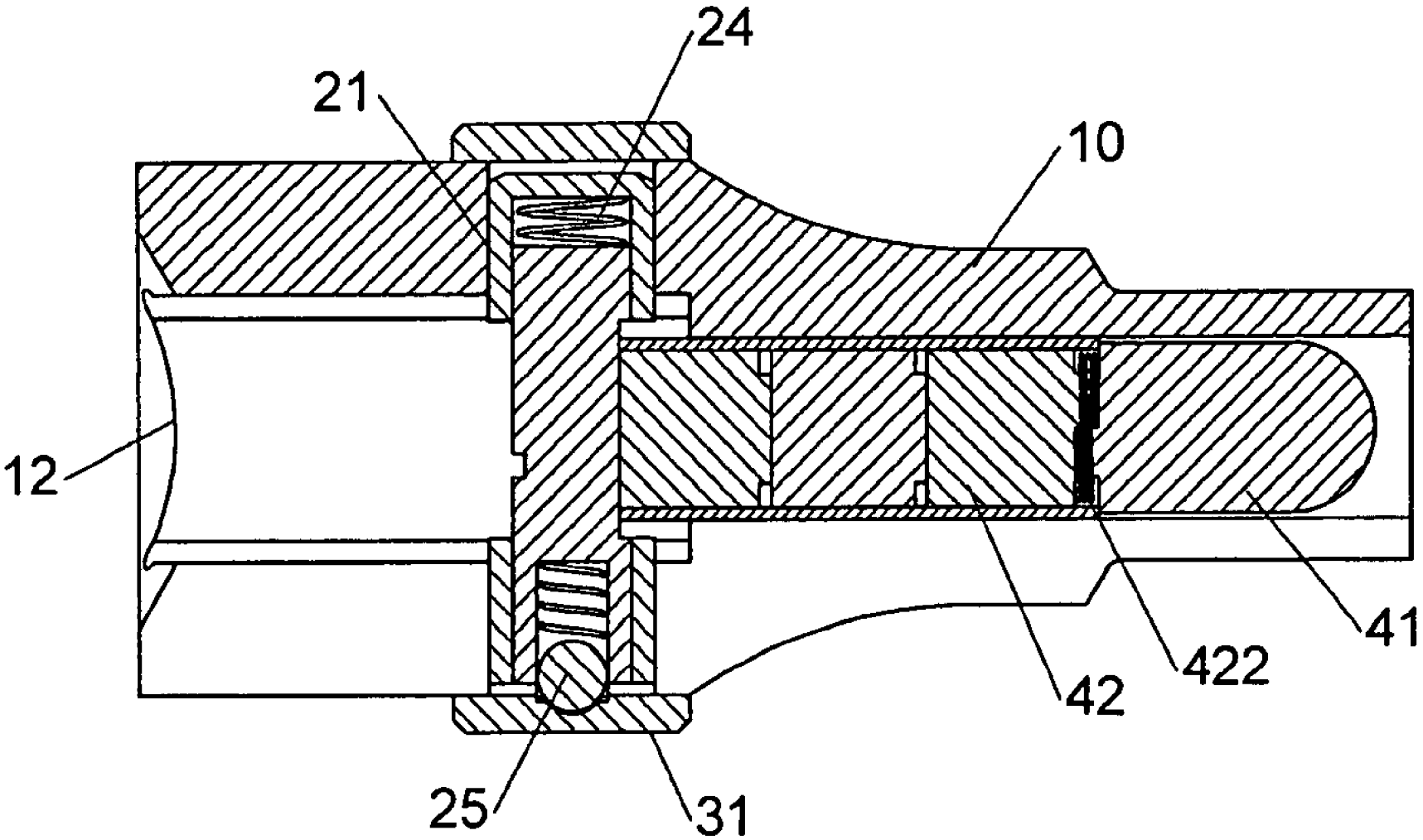
FIG. 18 is a side cross sectional view of the fourth embodiment of the extension bar of the present invention.

FIGS. 17 and 18 show a fourth embodiment of the extension bar of the present invention, wherein the first and second pieces 21, 22 of the conductive unit 20 are integrally formed as a tube 210 and the third piece 23 is received in the tube 210. Two openings 211 are defined through a wall of the tube 210 and located in opposite diametrically. The third piece 23 is in contact with the power supply unit 42 via the openings 211.

Figure 6:
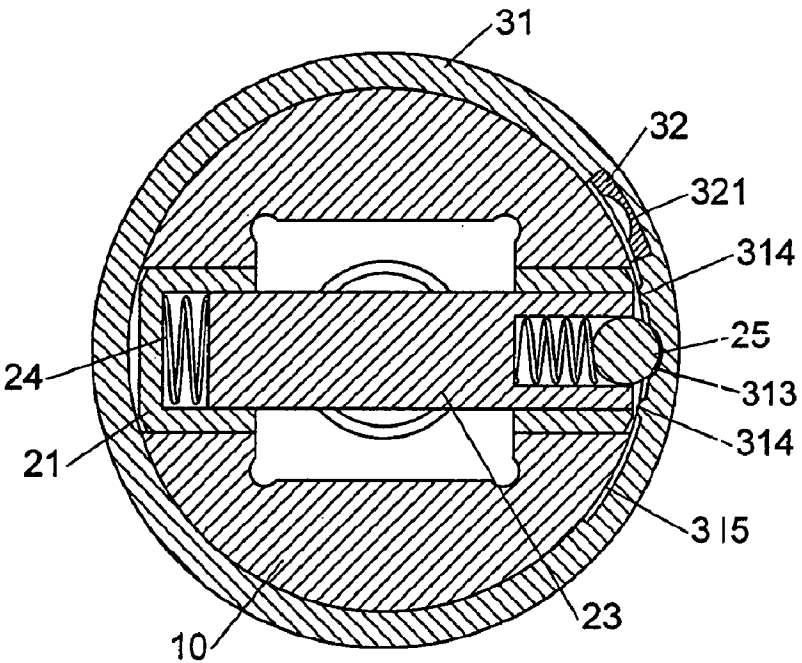
FIG. 6 is a cross-sectional view, taken along line I-I of FIG. 5.
Figure 7:
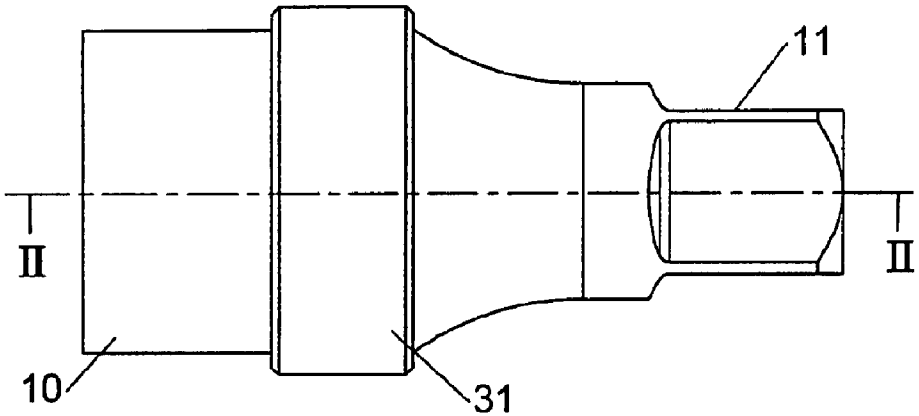
FIG. 7 is a top view of the first embodiment of the extension bar of the present invention.
Figure 8:
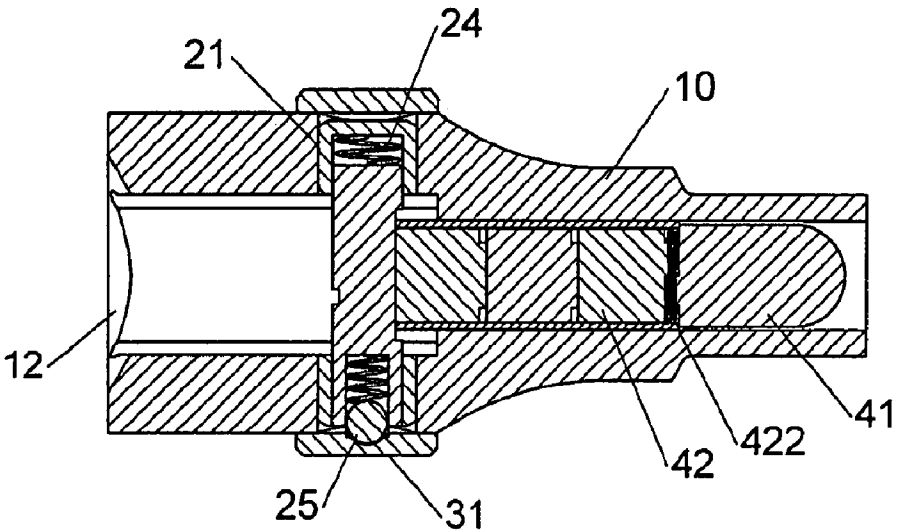
FIG. 8 is a cross-sectional view, taken along line II-II of FIG. 7.

When the first control member 31 is made to be non-conductive, the second control member 32 is made to be conductive as shown in FIG. 6, the illumination part 41 is electrically powered by the power supply unit 42. On the contrary, as disclosed in FIG. 9, the illumination part 41 is not powered by the power supply unit 42.

Figure 19:
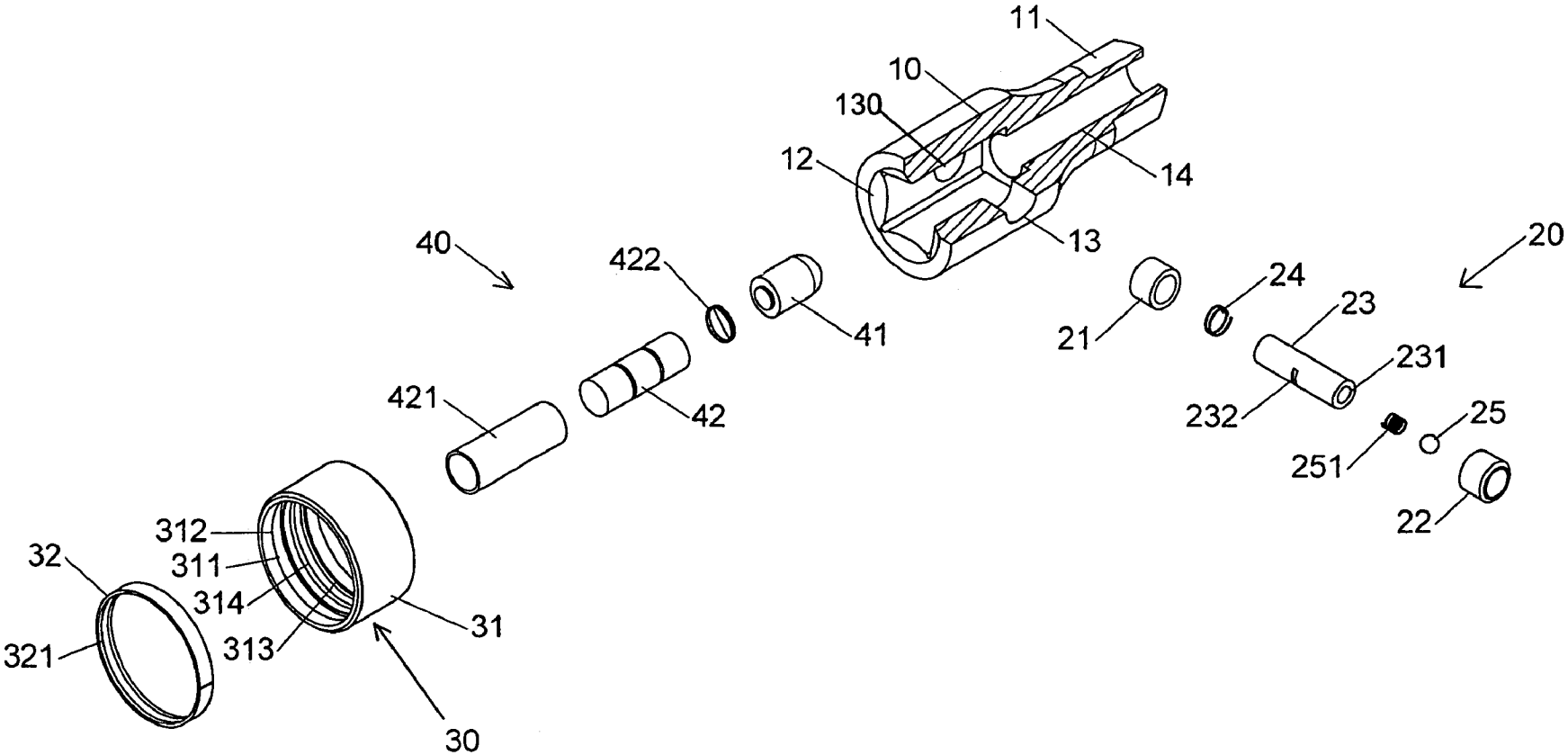
FIG. 19 is an exploded view to show a fifth embodiment of the extension bar of the present invention.
Figure 22:
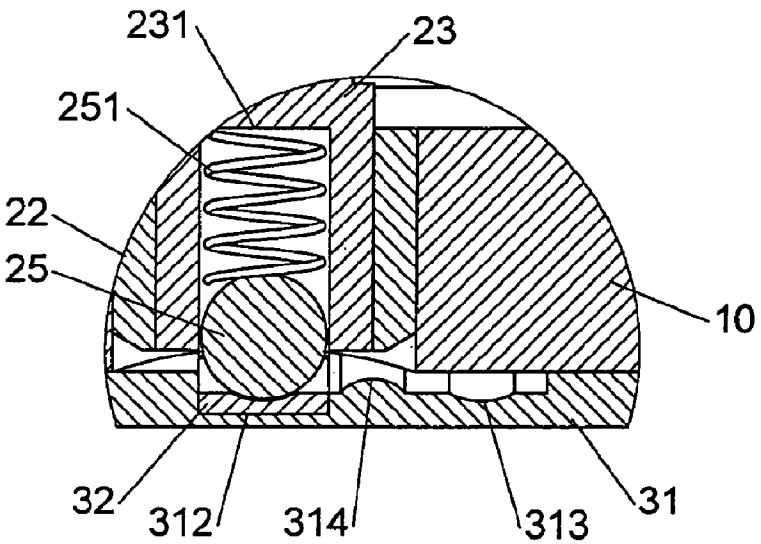
FIG. 22 is an enlarged cross sectional view of the circle B in FIG. 21.
Figure 20:
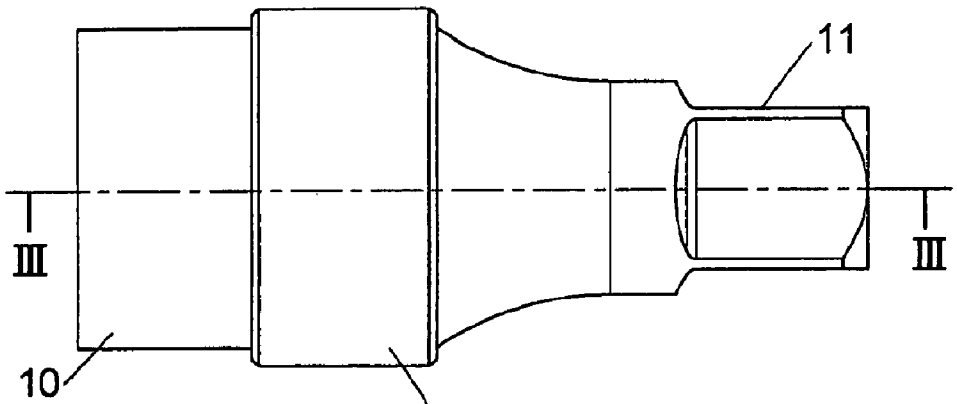
FIG. 20 is a top view to show the fifth embodiment of the extension bar of the present invention.
Figure 21:
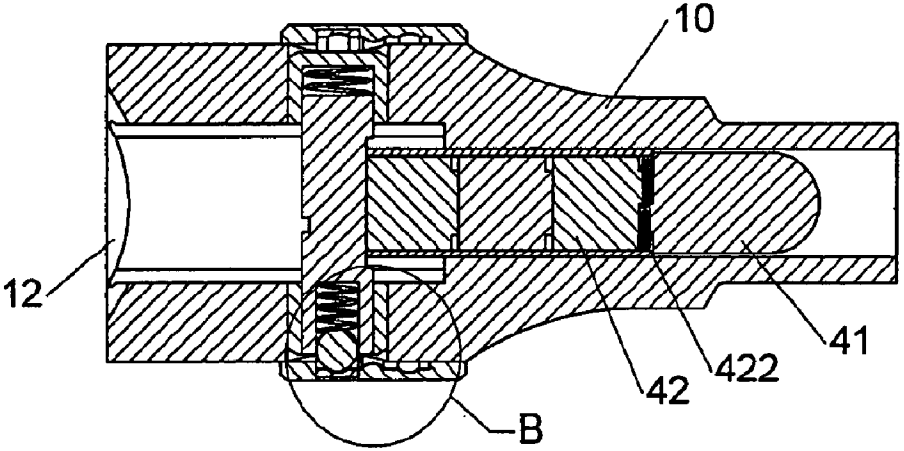
FIG. 21 is a cross-sectional view, taken along line III-III of FIG. 20.
Figure 24:
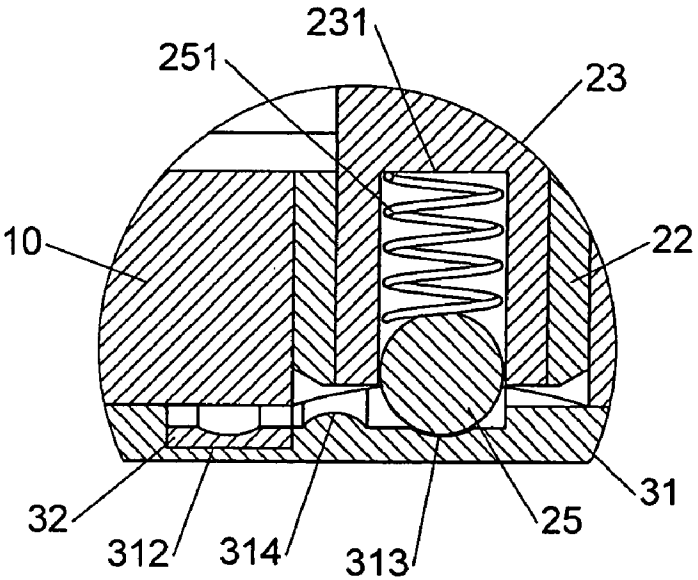
FIG. 24 is an enlarged cross sectional view of the circle B in FIG. 23.
Figure 23:
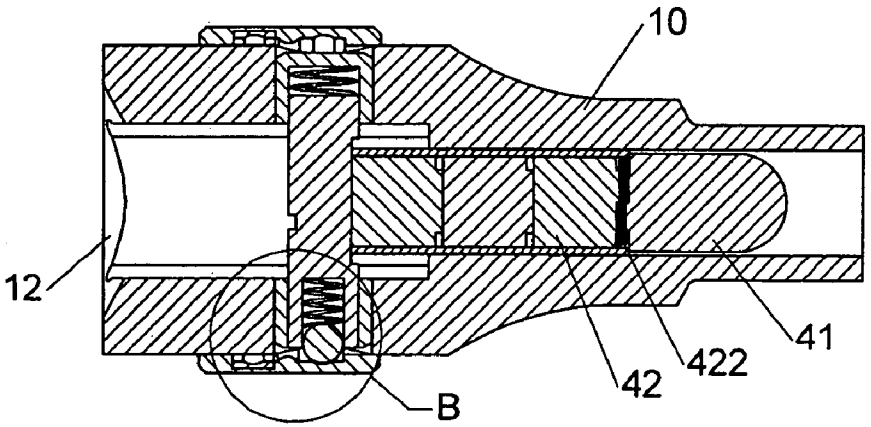
FIG. 23 is a cross sectional view of the fifth embodiment of the extension bar, wherein the bead is in contact with the second recess in the first control member.

FIGS. 19 to 21 show a fifth embodiment of the extension bar of the present invention, wherein the body 10, the conductive unit 20 and the illumination unit 40 are the same as the first embodiment, the difference is that the first control member 31 of the control unit 30 can be mounted to the body 10 and located corresponding to the radial holes 13, 130 and the first control member 31 are movable along an axial direction of the body 10. The first control member 31 is a conductive ring-shaped member and the second control member 32 is a non-conductive member. The first control member 31 includes an inner periphery which allows the first control member 31 to move along the axial direction of the body 10, and the first recessed area 311 of the first control member 31 is an annular groove. The first recessed area 311 includes the first recess 312 and the second recess 313, both which are annular grooves. A ridge 314 is located between the first and second recesses 312, 313, the ridge 314 is an annular ridge. The second control member 32 is a ring-shaped member and is securely engaged with the first recess 312. When the bead 25 is engaged with the second control member 32 in the first recess 312, and because the second control member 32 is a non-conductive member, so that the circuit cannot be established, as shown in FIGS. 21, 22. When the user shifts the first control member 31 to let the bead 25 engage with the second recess 313 of the first control member 31, the circuit is established.

Figure 25:
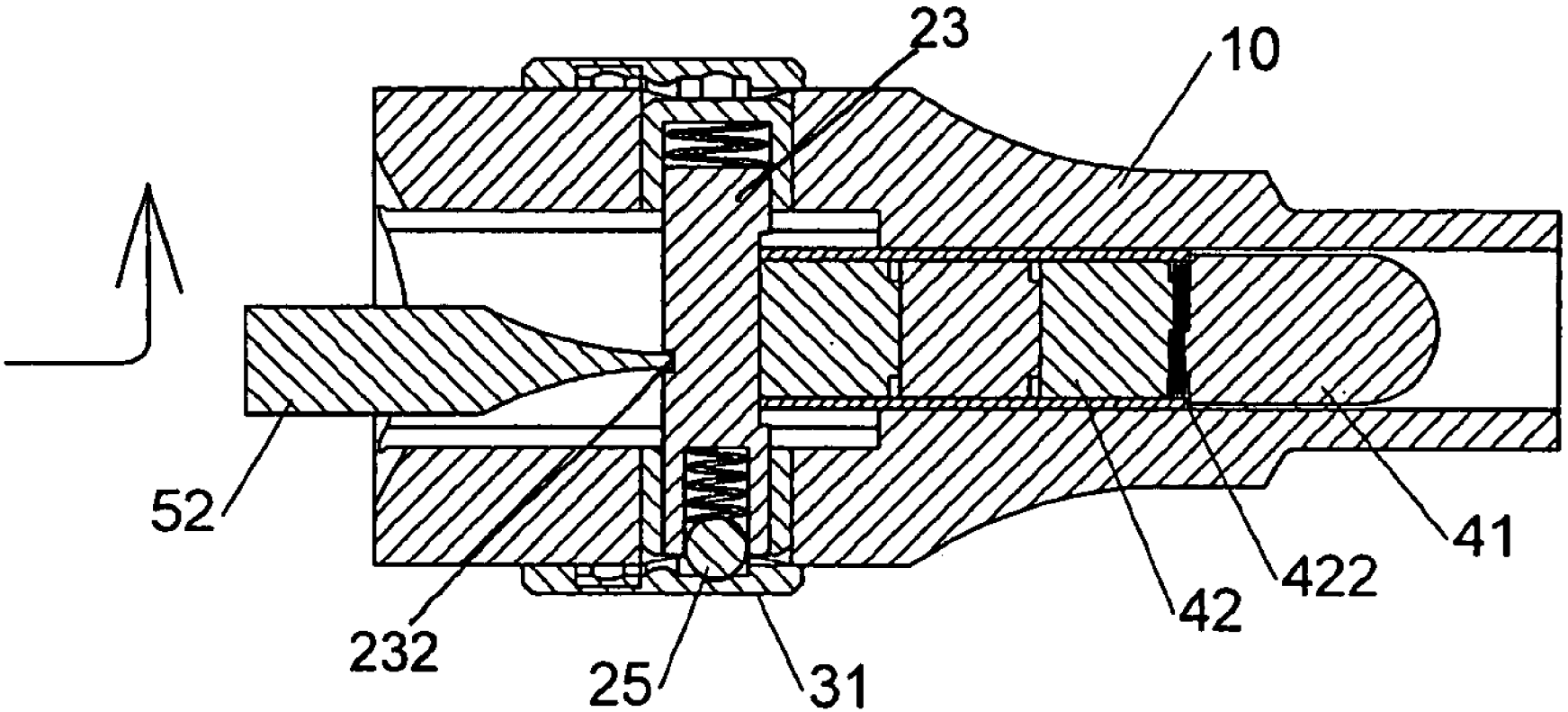
FIG. 25 shows a screw driver is engaged with the notch of the third piece of fifth embodiment of the extension bar.

As shown in FIG. 25, the user can use a screw driver 52 to engage the notch 232 of the third piece 23 and push the third piece 23 in the direction shown by the arrow head, the control unit 30 is separated from the bead 25 and can be removed from the body 10 to replace the power supply unit 42.

Figure 26:
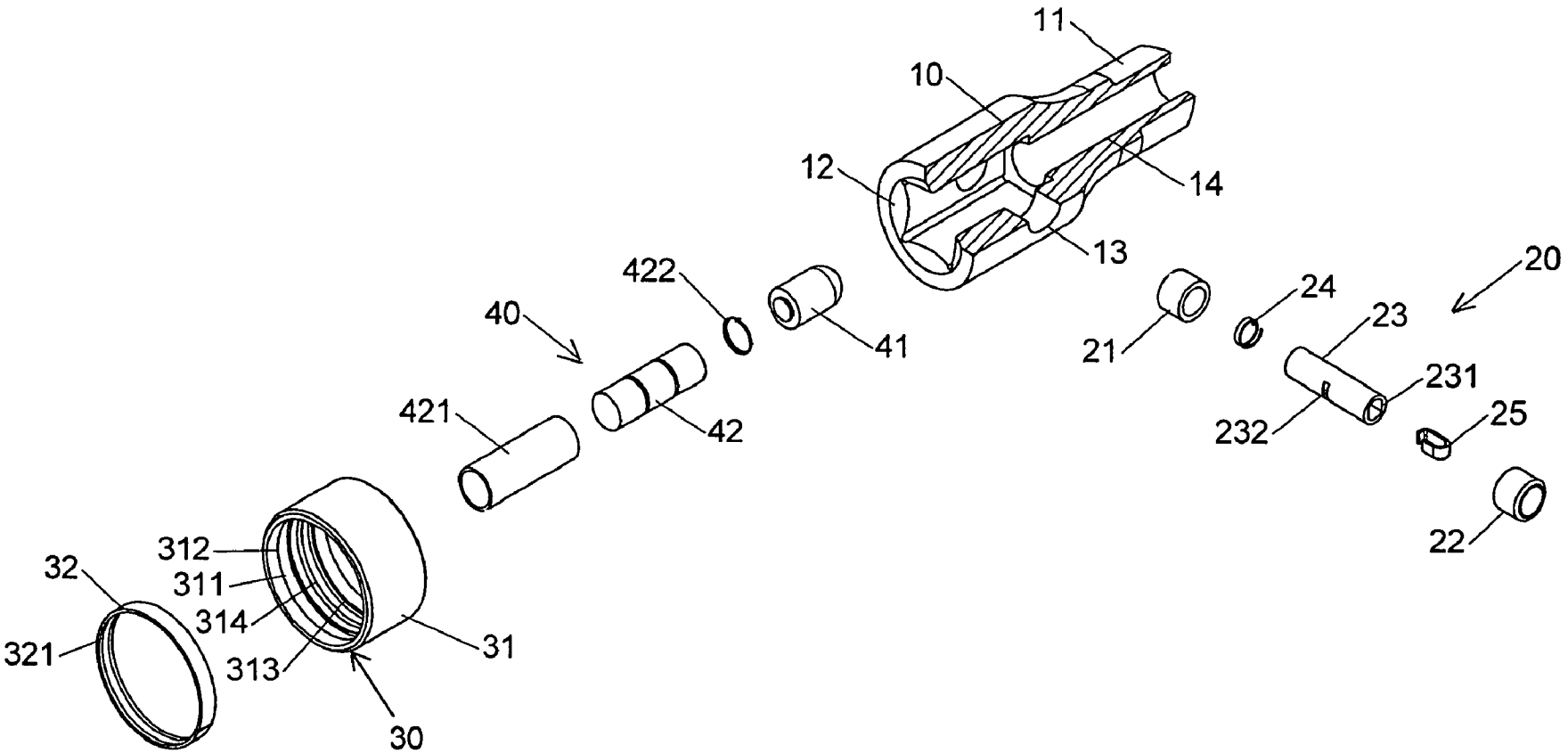
FIG. 26 is an exploded view to show a sixth embodiment of the extension bar of the present invention.
Figure 27:
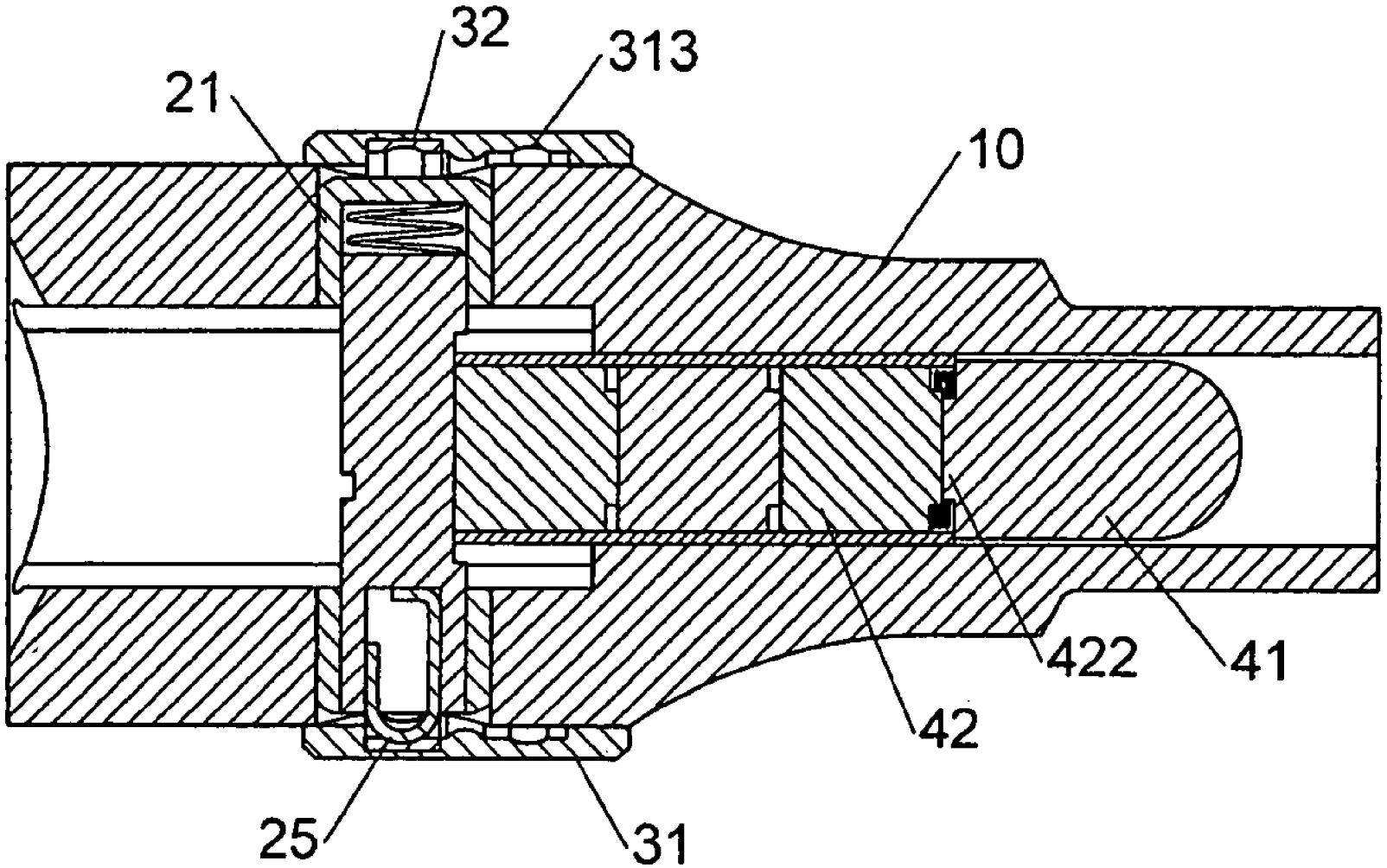
FIG. 27 is a cross sectional view of the sixth embodiment of the extension bar of the present invention.

FIGS. 26 and 27 show that the third piece 23 includes a reception hole 231 and the bead 25 is a substantially U-shaped plate.

Figure 28:
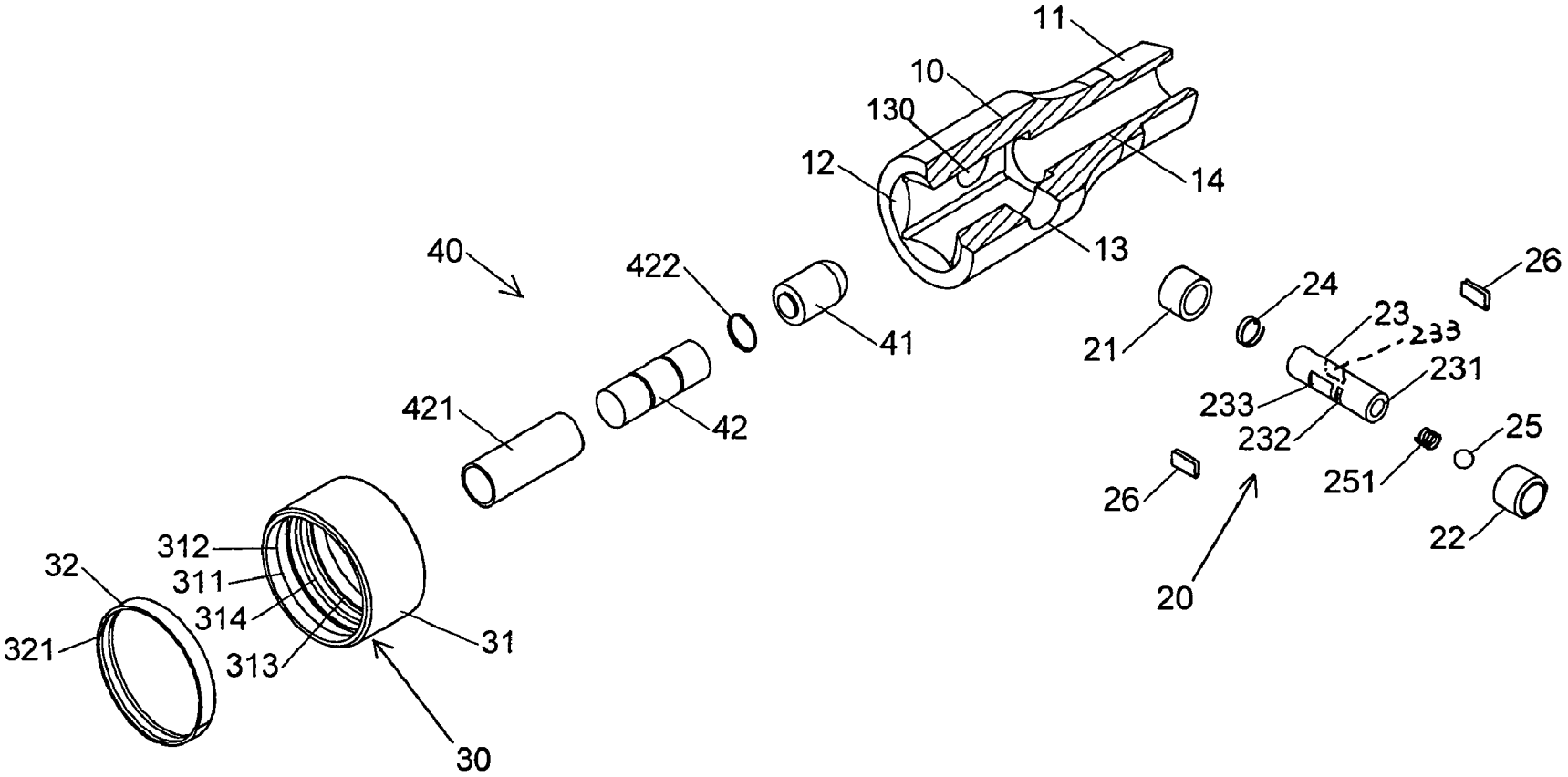
FIG. 28 is an exploded view to show a seventh embodiment of the extension bar of the present invention.
Figure 29:
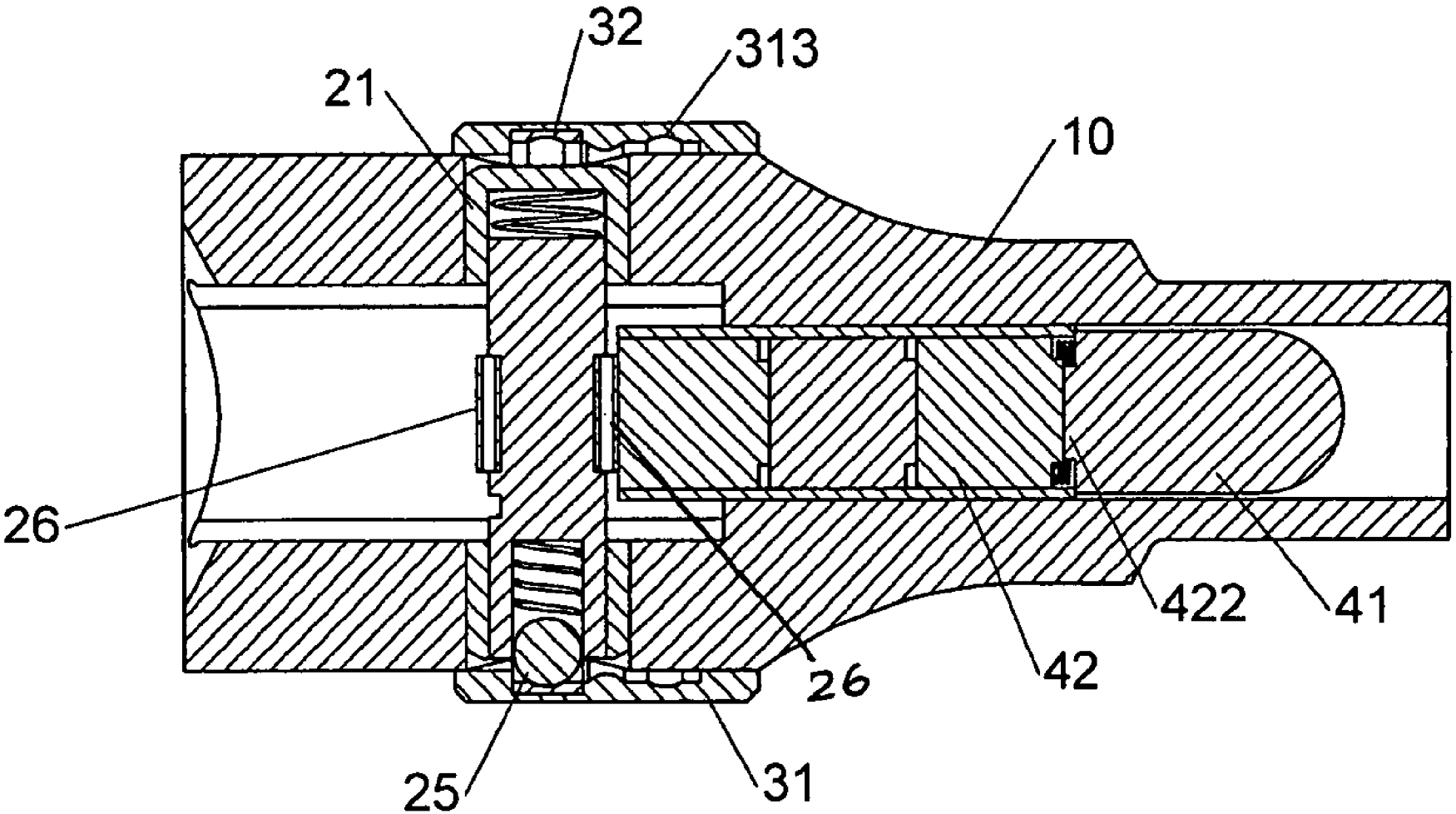
FIG. 29 is a cross sectional view of the seventh embodiment of the extension bar of the present invention.

FIGS. 28 and 29 show that the third piece 23 includes two openings 233 defined through a wall thereof and the two openings 233 are located in opposite diametrically. Two biasing plates 26 are engaged with the two openings 233 of the third piece 23 so as to be in contact with the power supply unit 42.

Figure 30:
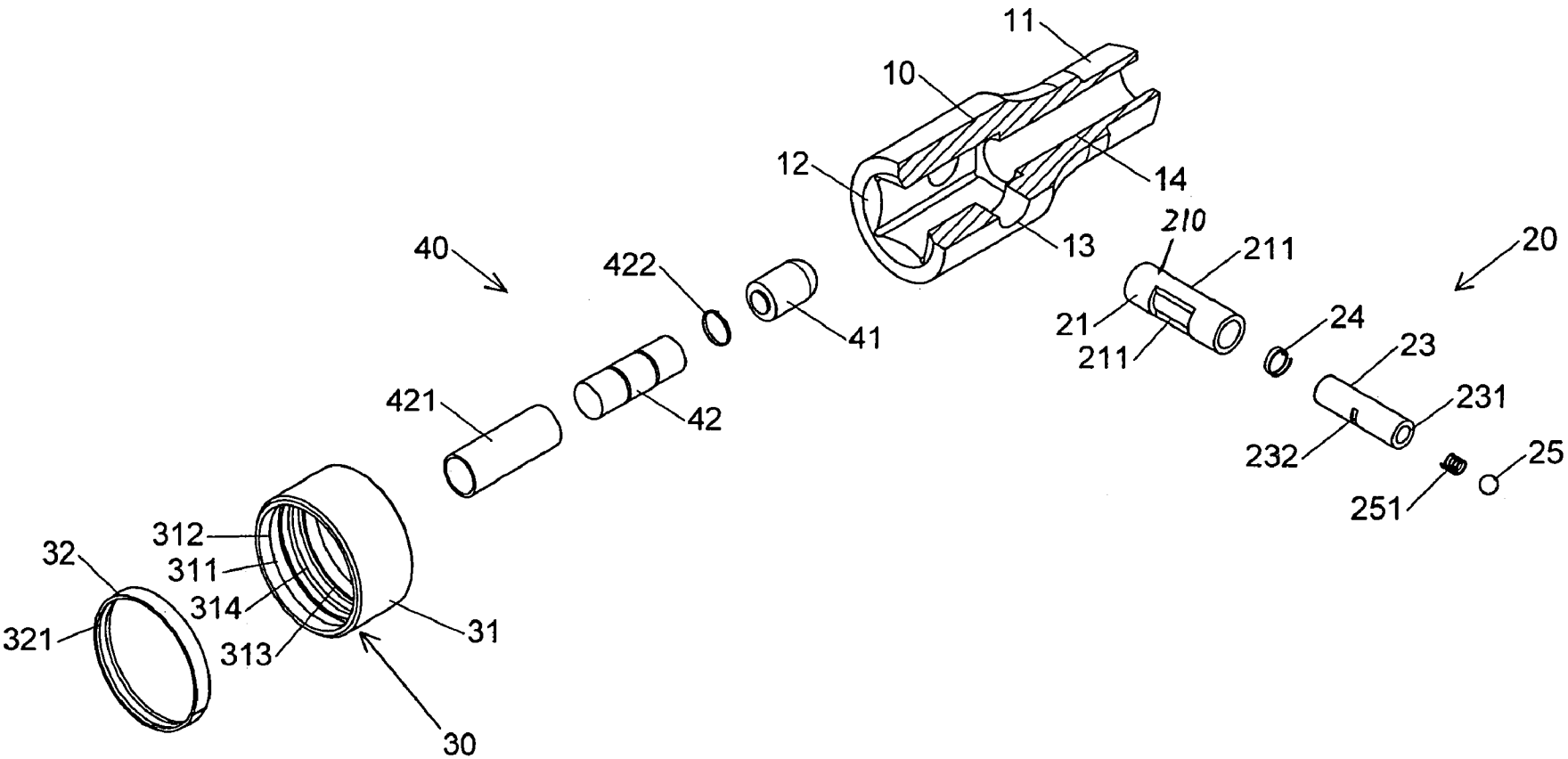
FIG. 30 is an exploded view to show an eighth embodiment of the extension bar of the present invention.
Figure 31:
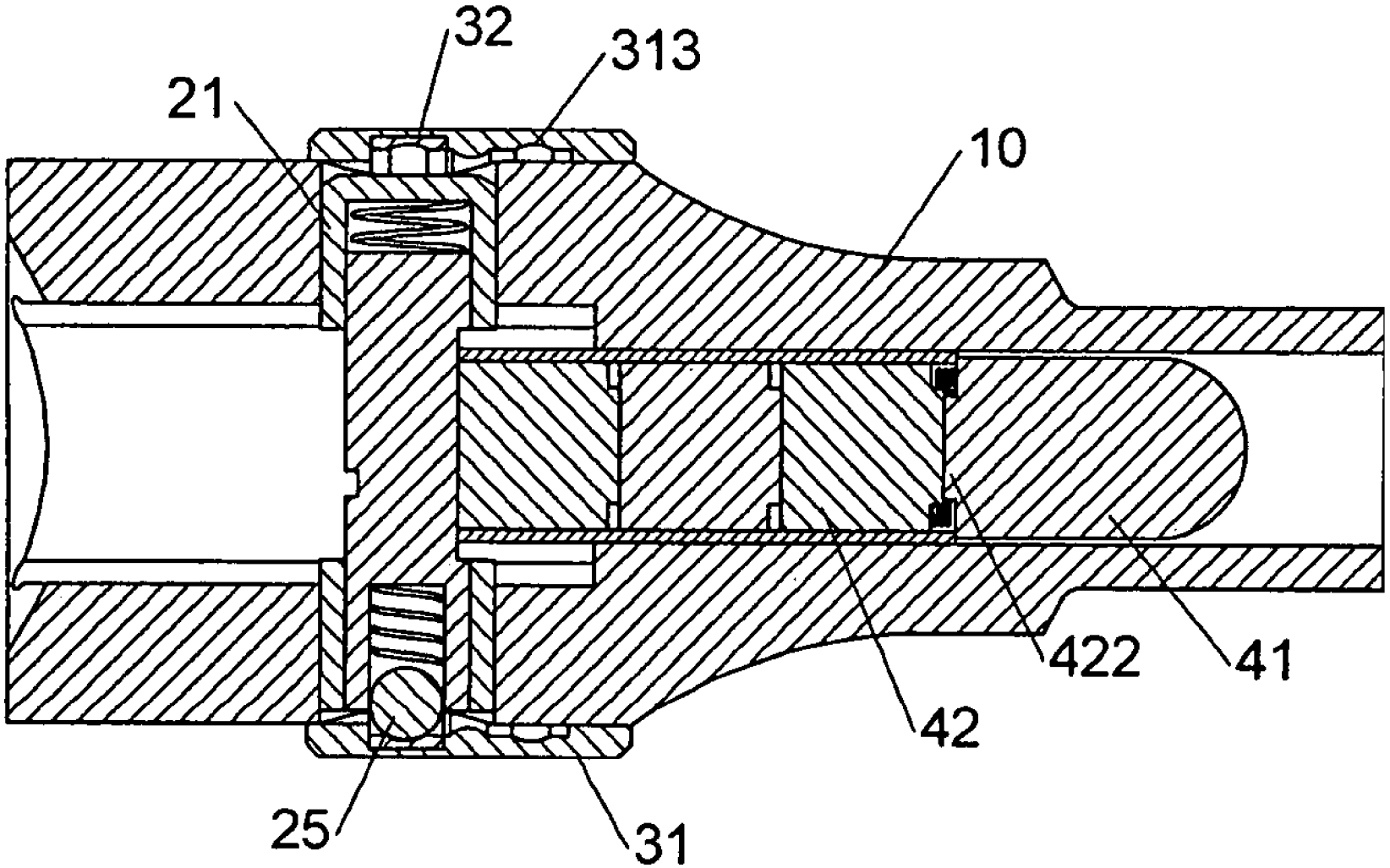
FIG. 31 is a cross sectional view of the eighth embodiment of the extension bar of the present invention.

FIGS. 30 and 31 show that the first and second pieces 21, 22 of the conductive unit 20 are integrally formed as a tube 210 and the third piece 23 is received in the tube 210. Two openings 211 are defined through a wall of the tube 210 and located in opposite diametrically. The third piece 23 is in contact with the power supply unit 42 via the openings 211. The first recessed area 311 of the first control member 31 is an annular recessed area and the first recess 312 and the second recess 313 are annular grooves. The ridge 314 is also an annular ridge located between the first and second recesses 312, 313. The second control member 32 is a ring-shaped member and located in the first recess 312.

The extension bar can be easily operated and the control unit can be easily removed from the body so as to replace parts therein. The illumination unit is activated when the square end of a tool is engaged with the engaging hole.

While we have shown and described the embodiment in accordance with the present invention, it should be clear to those skilled in the art that further embodiments may be made without departing from the scope of the present invention.

What is claimed is:

1. An extension bar for connecting with a hand tool, comprising:

an elongate body having a rectangular connection end at a first end thereof and a rectangular engaging hole defined in a second end of the body; two radial holes aligned along an axis and defined on a wall of the body and communicating with the engaging hole, and at least one radial hole through the wall of the body; a passage defined axially through the body and communicating with the engaging hole;

a conductive unit located in the radial holes of the body and including a first piece which is located in one of the radial hole and has an opening, the first piece being a non-conductive member;

a second piece which is a cylindrical member and located in the other radial hole, the second piece being a non-conductive member;

a third piece which is a cylindrical member and longer than a width of the engaging hole, the first and second pieces mounted on two ends of the third piece so that the two ends of the third piece are separated from the body by the first and second pieces, a conductive bead engaged with one end of the third piece and partially protruding beyond the body;

a control unit mounted to the body and located corresponding to the radial holes, the control unit including a first control member and a second control member, the first control member being a ring-shaped member and having an inner periphery to fit the body, the first control member located to hide the radial holes, a first recessed area defined in the inner periphery of the first control member, the first recessed area including a first recess and a second recess via which the bead is engaged, the second control member securely engaged with the first recess, when the control unit is rotated, the second control member is in contact with the bead and an exterior of the body, the first and second control members being opposite electric conductivity, and an illumination unit located in the passage of the body and including an illumination part located in the passage and being in contact with an inner periphery of the passage, a power supply unit located in the passage and having a first end being in contact with the illumination part, a second end of the power supply unit being in contact with the third piece and being not in contact with the body.

2. The extension bar as claimed in claim 1, wherein a first spring is located between the first and third pieces.

3. The extension bar as claimed in claim 1, wherein the third piece includes a reception hole defined in one end thereof and a second spring and the bead are engaged with the reception hole, the bead is a ball-shaped member and in contact with the third piece, the bead partially protrudes beyond the exterior of the body by the second spring.

4. The extension bar as claimed in claim 1, wherein the third piece includes a notch defined in an outer periphery thereof and the notch faces the engaging hole.

5. The extension bar as claimed in claim 1, wherein the first control member rotates relative to the body to control contact between the bead and the second control member.

6. The extension bar as claimed in claim 1, wherein the second recess of the first control member is a circular recess.

7. The extension bar as claimed in claim 1, wherein the first recess and the second recess are separated by a ridge located therebetween.

8. The extension bar as claimed in claim 1, wherein the first recessed area includes a third recess which includes an open end, the second recess and the third recess are separated by a ridge located therebetween.

9. The extension bar as claimed in claim 1, wherein the second control member includes a second recessed area which is located corresponding to the second recess, a circular recess is defined in the second recessed area and receives the bead, the second recessed area is located between two protrusions which have the same curvature as an inner periphery of the first control member, the protrusions of the second control member contact the exterior of the body.

10. The extension bar as claimed in claim 1, wherein a non-conductive separation member is mounted to the power supply unit so as to separate the power supply unit from the body.

11. The extension bar as claimed in claim 1, wherein a third spring is located between the power supply unit and the illumination part.

12. The extension bar as claimed in claim 1, wherein an annular groove is defined in the exterior of the body and located close to the engaging hole, a flange extends radially outward from the exterior of the body and located on one end of the annular groove, a plurality outer threads are defined in the exterior of the body and located on the other end of the annular groove, an end ring is threadedly connected to the outer threads, the first control member is rotatably engaged with the annular groove and restricted by the flange and the end ring.

13. The extension bar as claimed in claim 12, wherein the end ring, the first control member and the exterior of the body are in flush with each other.

14. The extension bar as claimed in claim 12, wherein the second recess of the first control member has two openings in two ends thereof.

15. The extension bar as claimed in claim 1, wherein the third piece and the bead are integrally formed as one piece.

16. The extension bar as claimed in claim 1, wherein the first and second pieces of the conductive unit are integrally formed as a tube and the third piece is received in the tube, two openings are defined through a wall of the tube and located in opposite diametrically, the third piece is in contact with the power supply unit via the openings.

17. The extension bar as claimed in claim 1, wherein the third piece includes a reception hole and the bead is a substantially U-shaped plate.

18. The extension bar as claimed in claim 1, wherein the third piece includes two openings defined through a wall thereof and the two openings are located in opposite diametrically, two biasing plates are engaged with the two openings of the third piece.

19. The extension bar as claimed in claim 1, wherein the first control member is a conductive ring-shaped member and includes an inner periphery which allows the first control member to move along an axial direction of the body, the first recessed area of the first control member, the first recess and the second recess are annular grooves, the bead is engaged with the second recess, the second control member is a non-conductive ring-shaped member and securely engaged with the first recess, the movement of the first control member along the body controls contact between the second control member and the bead.

* * * * *